US008054589B2

(12) United States Patent
Gowda et al.

(10) Patent No.: US 8,054,589 B2
(45) Date of Patent: Nov. 8, 2011

(54) SWITCH STRUCTURE AND ASSOCIATED CIRCUIT

(75) Inventors: Arun Virupaksha Gowda, Rexford, NY (US); Kathleen Ann O'Brien, Niskayuna, NY (US); John Norton Park, Rexford, NY (US); William James Premerlani, Scotia, NY (US); Owen Jannis Samuel Schelenz, Schenectady, NY (US); Kanakasabapathi Subramanian, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 125 days.

(21) Appl. No.: 12/639,060

(22) Filed: Dec. 16, 2009

(65) Prior Publication Data

US 2011/0140546 A1 Jun. 16, 2011

(51) Int. Cl.
*H01H 9/42* (2006.01)
*H01H 73/18* (2006.01)

(52) U.S. Cl. ..... 361/2; 361/8; 361/11; 361/13; 338/61

(58) Field of Classification Search ..... 361/2, 8, 361/11, 13; 338/61
See application file for complete search history.

(56) References Cited

U.S. PATENT DOCUMENTS

| | | | | |
|---|---|---|---|---|
| 4,070,641 | A * | 1/1978 | Khalid | 338/61 |
| 5,616,972 | A | 4/1997 | Weiser | |
| 6,630,725 | B1 * | 10/2003 | Kuo et al. | 257/659 |
| 6,649,852 | B2 * | 11/2003 | Chason et al. | 200/181 |
| 6,815,739 | B2 * | 11/2004 | Huff et al. | 257/275 |
| 6,873,223 | B2 * | 3/2005 | Stokes et al. | 333/105 |
| 7,012,327 | B2 * | 3/2006 | Huff et al. | 257/686 |
| 7,079,363 | B2 * | 7/2006 | Chung | 361/13 |
| 7,119,943 | B2 * | 10/2006 | Nelson et al. | 359/291 |
| 7,274,278 | B2 * | 9/2007 | Weller et al. | 333/262 |
| 7,486,488 | B2 * | 2/2009 | Wakatsuki et al. | 361/11 |
| 7,542,250 | B2 | 6/2009 | Premerlani et al. | |
| 7,554,222 | B2 | 6/2009 | Kumfer et al. | |
| 7,589,942 | B2 | 9/2009 | Kumfer et al. | |

(Continued)

FOREIGN PATENT DOCUMENTS

| | | |
|---|---|---|
| EP | 2045823 A2 | 4/2009 |
| EP | 2056325 A2 | 5/2009 |
| FR | 2797359 A1 | 2/2001 |

OTHER PUBLICATIONS

European Search Report dated Mar. 24, 2011 and Written Opinion.

*Primary Examiner* — Rexford Barnie
*Assistant Examiner* — Zeev V Kitov
(74) *Attorney, Agent, or Firm* — Richard D. Emery

(57) ABSTRACT

An apparatus, such as a switch module, is provided. The apparatus can include an electromechanical switch structure configured to move between an open configuration and a fully-closed configuration (associated with a minimum characteristic resistance) over a characteristic time. A commutation circuit can be connected in parallel with the electromechanical switch structure, and can include a balanced diode bridge configured to suppress arc formation between contacts of the electromechanical switch structure and a pulse circuit including a pulse capacitor configured to form a pulse signal (in connection with a switching event of the electromechanical switch structure) for causing flow of a pulse current through the balanced diode bridge. The electromechanical switch structure and the balanced diode bridge can be disposed such that a total inductance associated with the commutation circuit is less than or equal to a product of the characteristic time and the minimum characteristic resistance.

20 Claims, 16 Drawing Sheets

U.S. PATENT DOCUMENTS 7,612,971 B2 11/2009 Premerlani et al.
7,688,167 B2 * 3/2010 Paranjpye et al. ..... 335/78
7,741,936 B1 * 6/2010 Weller et al. ..... 333/262
2008/0308394 A1 12/2008 Premerlani et al.
2009/0125124 A1 5/2009 Premerlani et al.
2009/0130910 A1 * 5/2009 Inha et al. ..... 439/638

* cited by examiner

SWITCH STRUCTURE AND ASSOCIATED CIRCUIT

BACKGROUND

Embodiments of the invention relate generally to devices for switching current, and more particularly to microelectromechanical switch structures.

A circuit breaker is an electrical device designed to protect electrical equipment from damage caused by faults in the circuit. Traditionally, many conventional circuit breakers include bulky (macro-)electromechanical switches. Unfortunately, these conventional circuit breakers are large in size may necessitate use of a large force to activate the switching mechanism. Additionally, the switches of these circuit breakers generally operate at relatively slow speeds. Furthermore, these circuit breakers can be complex to build and thus expensive to fabricate. In addition, when contacts of the switching mechanism in conventional circuit breakers are physically separated, an arc can sometimes form therebetween, which arc allows current to continue to flow through the switch until the current in the circuit ceases. Moreover, energy associated with the arc may seriously damage the contacts and/or present a burn hazard to personnel.

As an alternative to slow electromechanical switches, relatively fast solid-state switches have been employed in high speed switching applications. These solid-state switches switch between a conducting state and a non-conducting state through controlled application of a voltage or bias. However, since solid-state switches do not create a physical gap between contacts when they are switched into a non-conducting state, they experience leakage current when nominally non-conducting. Furthermore, solid-state switches operating in a conducting state experience a voltage drop due to internal resistances. Both the voltage drop and leakage current contribute to power dissipation and the generation of excess heat under normal operating circumstances, which may be detrimental to switch performance and life. Moreover, due at least in part to the inherent leakage current associated with solid-state switches, their use in circuit breaker applications is not possible.

Micro-electromechanical system (MEMS) based switching devices may provide a useful alternative to the macro-electromechanical switches and solid-state switches described above for certain current switching applications. MEMS-based switches tend to have a low resistance when set to conduct current, and low (or no) leakage when set to interrupt the flow of current therethrough. Further, MEMS-based switches are expected to exhibit faster response times than macro-electromechanical switches.

BRIEF DESCRIPTION

In one aspect, an apparatus, such as a switch module, is provided. The apparatus can include an electromechanical switch structure configured to move between an open configuration and a fully-closed configuration over a characteristic time (e.g., less than or equal to about 15 microseconds). When in the fully-closed configuration, the electromechanical switch structure can have a minimum characteristic resistance.

The electromechanical switch structure can include one or more contacts and one or more moveable elements, with each of the moveable elements being in maximum contact with at least one of the contacts when the electromechanical switch structure is disposed in the fully-closed configuration and each of the moveable elements being separated from the contacts when the electromechanical switch structure is disposed in the open configuration. The electromechanical switch structure can include, for example, a microelectromechanical switch. The electromechanical switch structure can also include an electrode configured to selectively receive a charge so as to establish a potential difference with the moveable element and thereby urge the moveable element over the characteristic time between a maximum contacting position, in which said moveable element makes maximum contact with the contact, and a non-contacting position, in which said moveable element is separated from the contact.

The electromechanical switch structure can include an array of electromechanical switches having a minimum characteristic effective array resistance when in the fully-closed configuration. The array can include at least two electromechanical switches connected in parallel and/or at least two electromechanical switches connected in series.

A commutation circuit can be connected in parallel with the electromechanical switch structure. The commutation circuit can include a balanced diode bridge configured to suppress arc formation between contacts of the electromechanical switch structure. The commutation circuit can also include a pulse circuit including a pulse capacitor configured to form a pulse signal for causing flow of a pulse current through the balanced diode bridge. The pulse signal can be generated in connection with a switching event of the electromechanical switch structure. The electromechanical switch structure and the balanced diode bridge can be disposed such that a total inductance associated with the commutation circuit is less than or equal to a product of the characteristic time and the minimum characteristic resistance.

In some embodiments, a second electromechanical switch structure can be included, the second electromechanical switch structure being configured to move between an open configuration and a fully-closed configuration over a second characteristic time. The second electromechanical switch structure can have a second minimum characteristic resistance when in the fully closed configuration. The (first) electromechanical switch structure can then be associated with a first characteristic time and a first minimum characteristic resistance. The first and second electromechanical switch structures can be configured to connect in parallel to a load circuit, with the commutation circuit connected in parallel with each of the first and second electromechanical switch structures. A first balanced diode bridge can be configured to suppress arc formation between contacts of the first electromechanical switch structure, and a second balanced diode bridge can be configured to suppress arc formation between contacts of the second electromechanical switch structure. The pulse circuit can include a pulse capacitor configured to form a pulse signal for causing flow of a pulse current through each of the first and second balanced diode bridges, the pulse signal being generated in connection with a switching event of the first and second electromechanical switch structures. The first and second electromechanical switch structures and the first and second balanced diode bridges can be disposed such that a total inductance associated with the pulse circuit and the first balanced diode bridge is less than or equal to a product of the first characteristic time and the first minimum characteristic resistance, while a total inductance associated with the pulse circuit and the second balanced diode bridge is less than or equal to a product of the second characteristic time and the second minimum characteristic resistance.

In another aspect, an apparatus, such as a switch module, is provided. The apparatus can include a first electromechanical switch structure configured to move between a fully-open configuration and a fully-closed configuration over a first characteristic time, and a second electromechanical switch structure configured to move between a fully-open configuration and a fully-closed configuration over a second characteristic time. The first electromechanical switch structure can have a first minimum characteristic resistance when in the fully closed configuration, and the second electromechanical switch structure can have a second minimum characteristic resistance when in the fully closed configuration. The second electromechanical switch structure can be configured to connect to a load circuit in parallel or in series with the first electromechanical structure.

A first commutation circuit can be connected in parallel with the first electromechanical switch structure. The first commutation circuit can include a first balanced diode bridge and a first pulse circuit. The first balanced diode bridge can be configured to suppress arc formation between contacts of the first electromechanical switch structure. The first pulse circuit can include a pulse capacitor configured to form a pulse signal for causing flow of a pulse current through the first balanced diode bridge, the pulse signal being generated in connection with a switching event of the first electromechanical switch structure.

A second commutation circuit can be connected in parallel with the second electromechanical switch structure. The second commutation circuit can include a second balanced diode bridge and a second pulse circuit. The second balanced diode bridge can be configured to suppress arc formation between contacts of the second electromechanical switch structure. The second pulse circuit can include a pulse capacitor configured to form a pulse signal for causing flow of a pulse current through the second balanced diode bridge, the pulse signal being generated in connection with a switching event of the second electromechanical switch structure.

The first electromechanical switch structure and the first balanced diode bridge can be disposed such that a total inductance associated with the first commutation circuit is less than or equal to a product of the first characteristic time and the first minimum characteristic resistance. The second electromechanical switch structure and the second balanced diode bridge can also be disposed such that a total inductance associated with the second commutation circuit is less than or equal to a product of the second characteristic time and the second minimum characteristic resistance.

In yet another aspect, a method is disclosed, the method including providing an apparatus including an electromechanical switch structure and a commutation circuit connected in parallel with the electromechanical switch structure. The electromechanical switch structure can be configured to move between an open configuration and a fully-closed configuration, having a minimum characteristic resistance when in the fully-closed configuration. The commutation circuit can include a balanced diode bridge configured to suppress arc formation between contacts of the electromechanical switch structure. A pulse circuit including a pulse capacitor can be configured to form a pulse signal for causing flow of a pulse current through the balanced diode bridge, the pulse signal being generated in connection with a switching event of the electromechanical switch structure. An electrostatic force can be applied to move the electromechanical switch structure into the fully-closed configuration. The electrostatic force can be varied so as to move the electromechanical switch structure over a characteristic time from the fully-closed configuration to the open configuration, wherein the characteristic time is greater than a total inductance associated with said commutation circuit divided by the minimum characteristic resistance.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
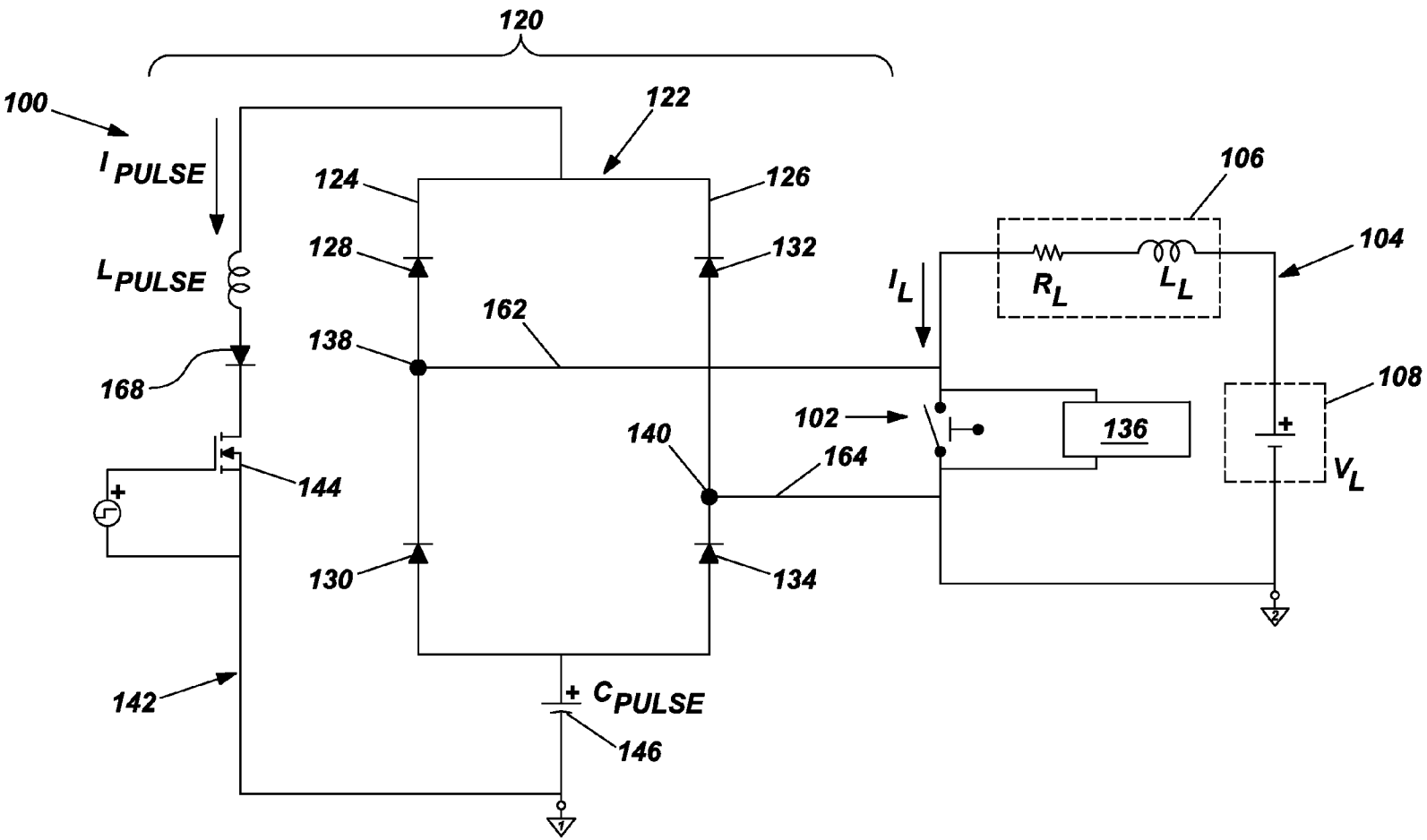
FIG. 1 is a schematic view of a switch module configured in accordance with an example embodiment.

Example embodiments of the present invention are described below in detail with reference to the accompanying drawings, where the same reference numerals denote the same parts throughout the drawings. Some of these embodiments may address the above and other needs.

Referring to FIG. 1, therein is shown an apparatus, such as a switch module 100 (e.g., for use in conjunction with motor starter applications), configured in accordance with an example embodiment. The switch module 100 can include an electromechanical switch structure, such as a microelectromechanical switch or a microelectromechanical system (MEMS) switch 102. The MEMS switch 102 can be incorporated as part of a load circuit 104 that also includes, for example, an electrical load 106 characterized by a load inductance $L_L$ and a load resistance $R_L$. It is noted that the load circuit 104 may also include inherent inductance and resistance, and these will contribute to, and will be considered to be included in, the effective load inductance $L_L$ and a load resistance $R_L$. A power source 108 can also be included in the load circuit 104 so as to provide a voltage $V_L$. As discussed further below, during operation, a load circuit current $I_L$ may flow through the load circuit 104 and, in some cases, the MEMS switch 102.

Figure 2:
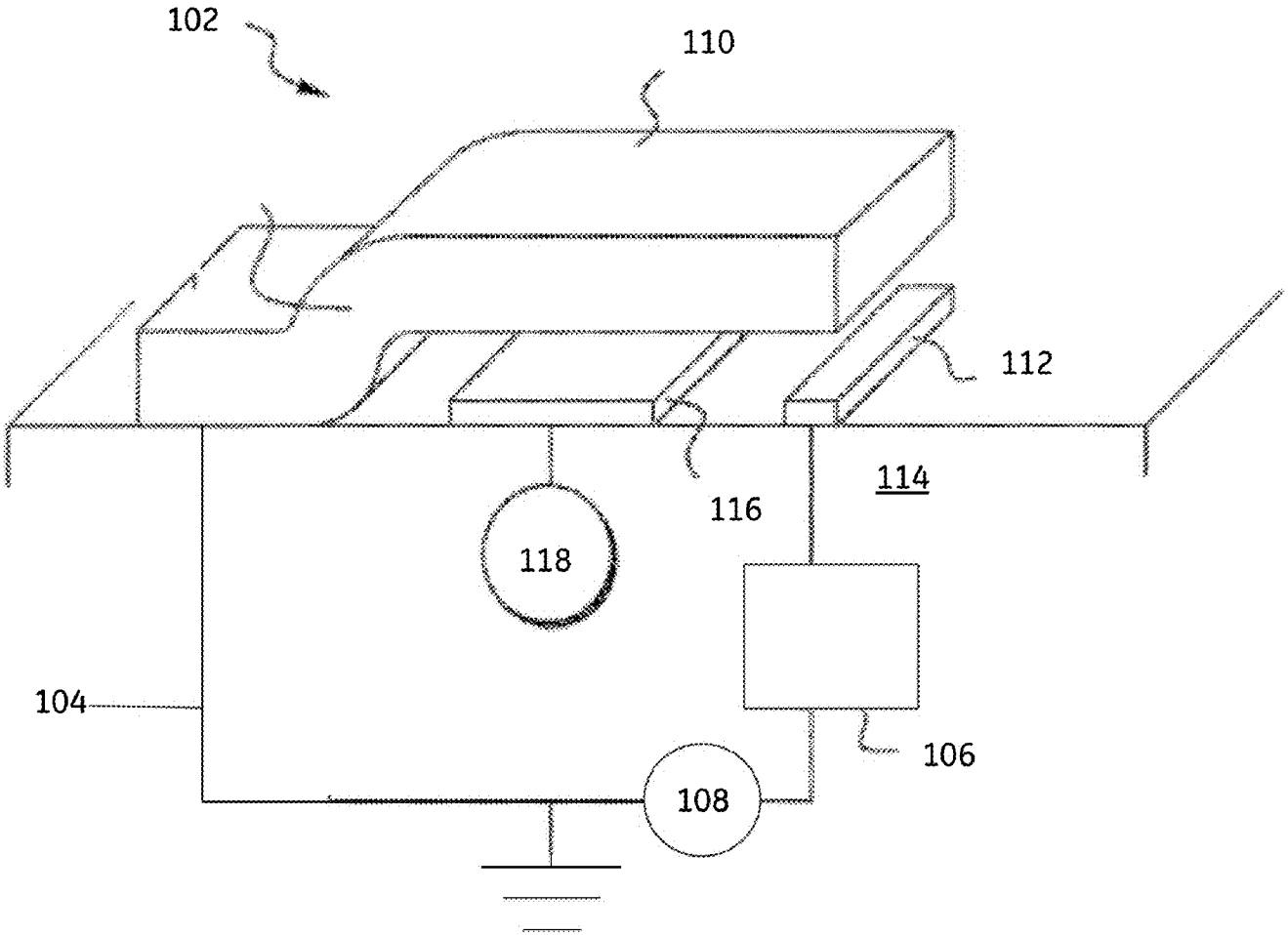
FIG. 2 is a schematic perspective view of an example electromechanical switch.

Referring to FIGS. 1 and 2, the MEMS switch 102 can include contacts, such as a moveable element (e.g., as a cantilevered beam 110) and a contact 112, (e.g., a conductive pad). The beam 110 and contact 112 can be supported by an underlying support structure, such as a substrate 114. Disposing the beam 110 and the contact 112 on a common substrate 114 may facilitate the production of the MEMS switch 102 through conventional microfabrication techniques (e.g., electroplating, vapor deposition, photolithography, wet and/or dry etching, etc.), with the resulting switch having dimensions on the order of ones or tens of micrometers and/or nanometers.

It is noted that while the electromechanical switch structure referenced above was described in terms of a solitary switch 102 having a single moveable element, the electromechanical switch structure may include an array of electromechanical switches connected in parallel, in series, or both, where each switch of the array includes a moveable element that is associated with a common or individual contacts. As such, references throughout to "a switch" (e.g., MEMS switch 102) should be understood to refer to either a single switch or a switch array.

Figure 3:
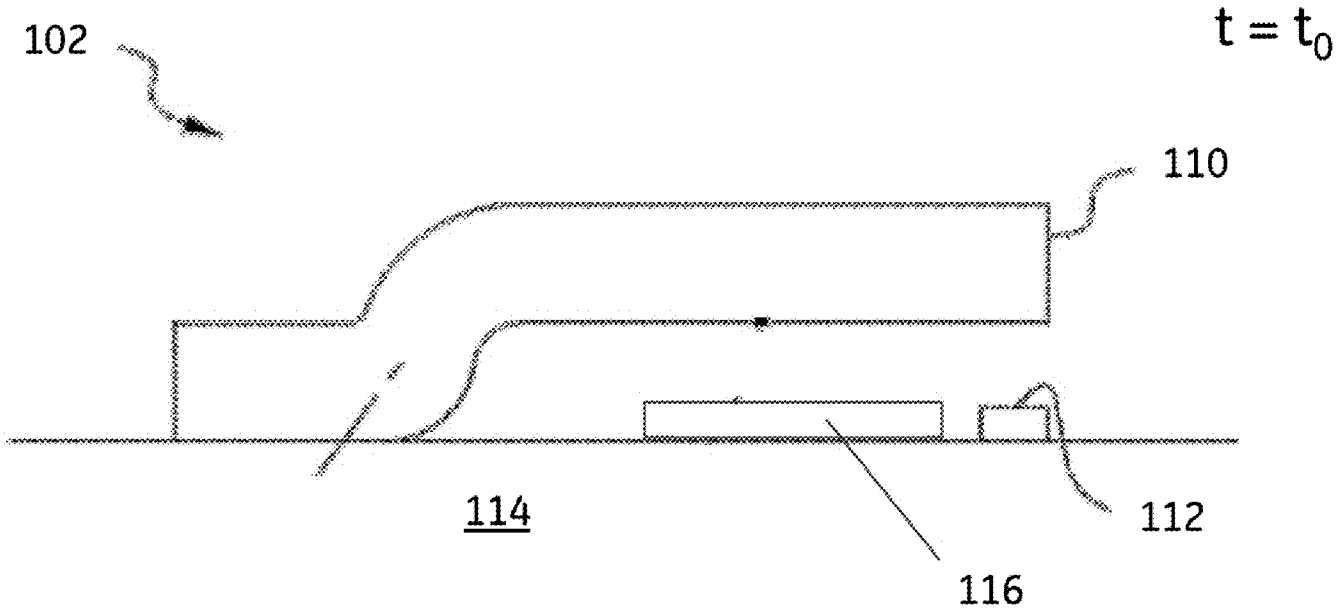
FIG. 3 is a side view of the switch of FIG. 2.
Figure 4:
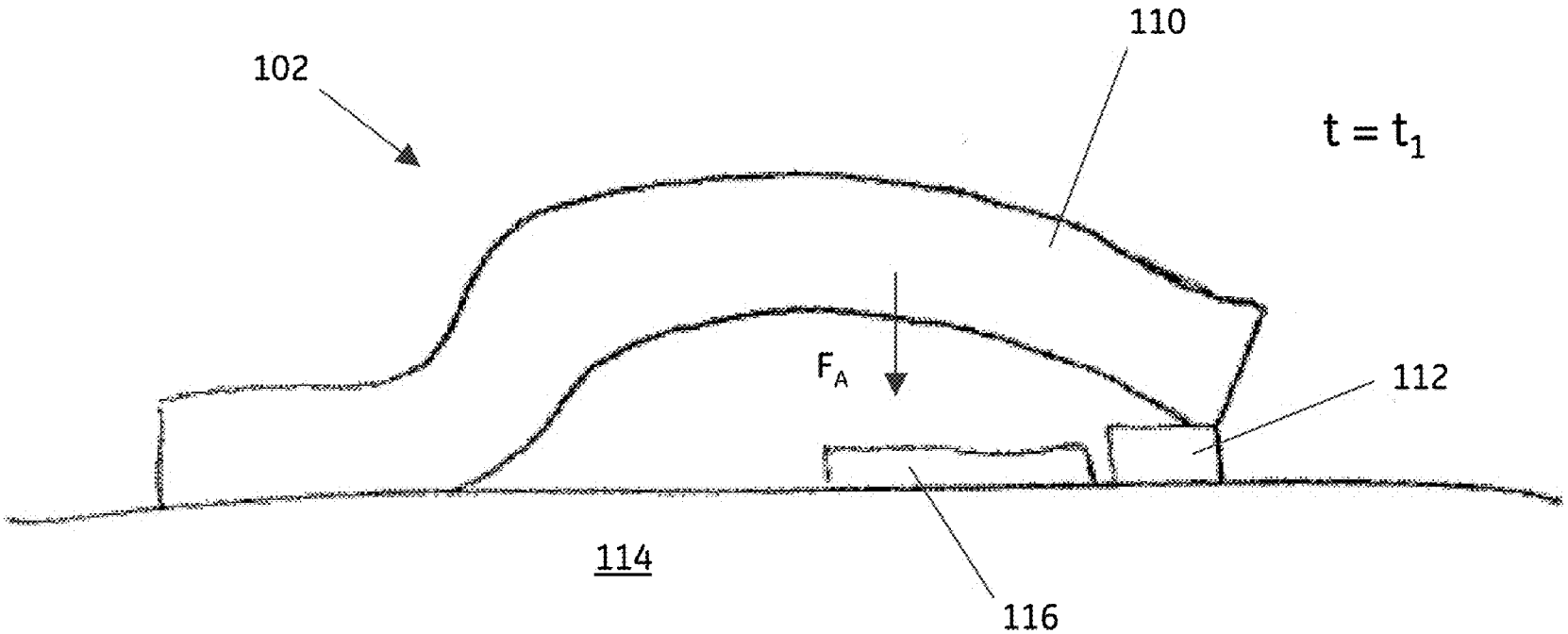
FIG. 4 is a side view of the switch of FIG. 2 in a partially-closed configuration.
Figure 5:
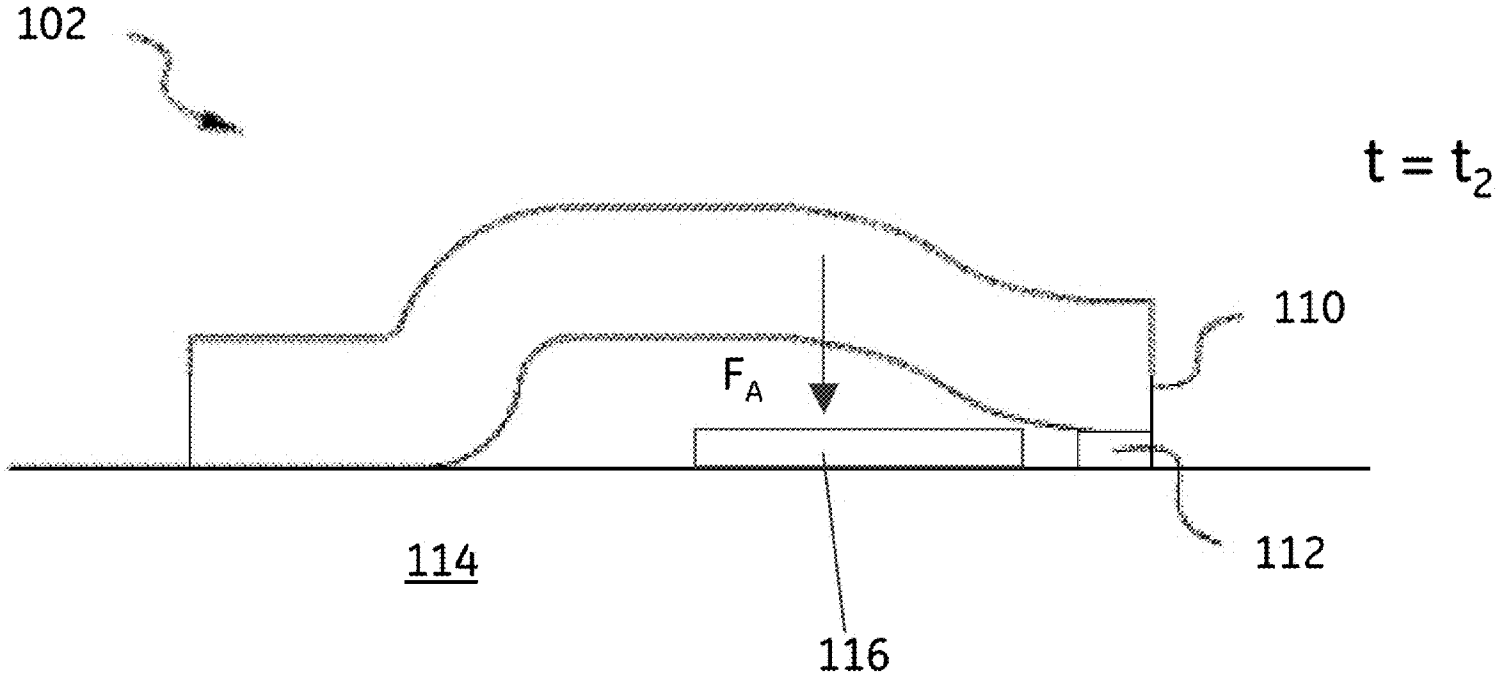
FIG. 5 is a side view of the switch of FIG. 2 in a fully-closed configuration.
Figure 6:
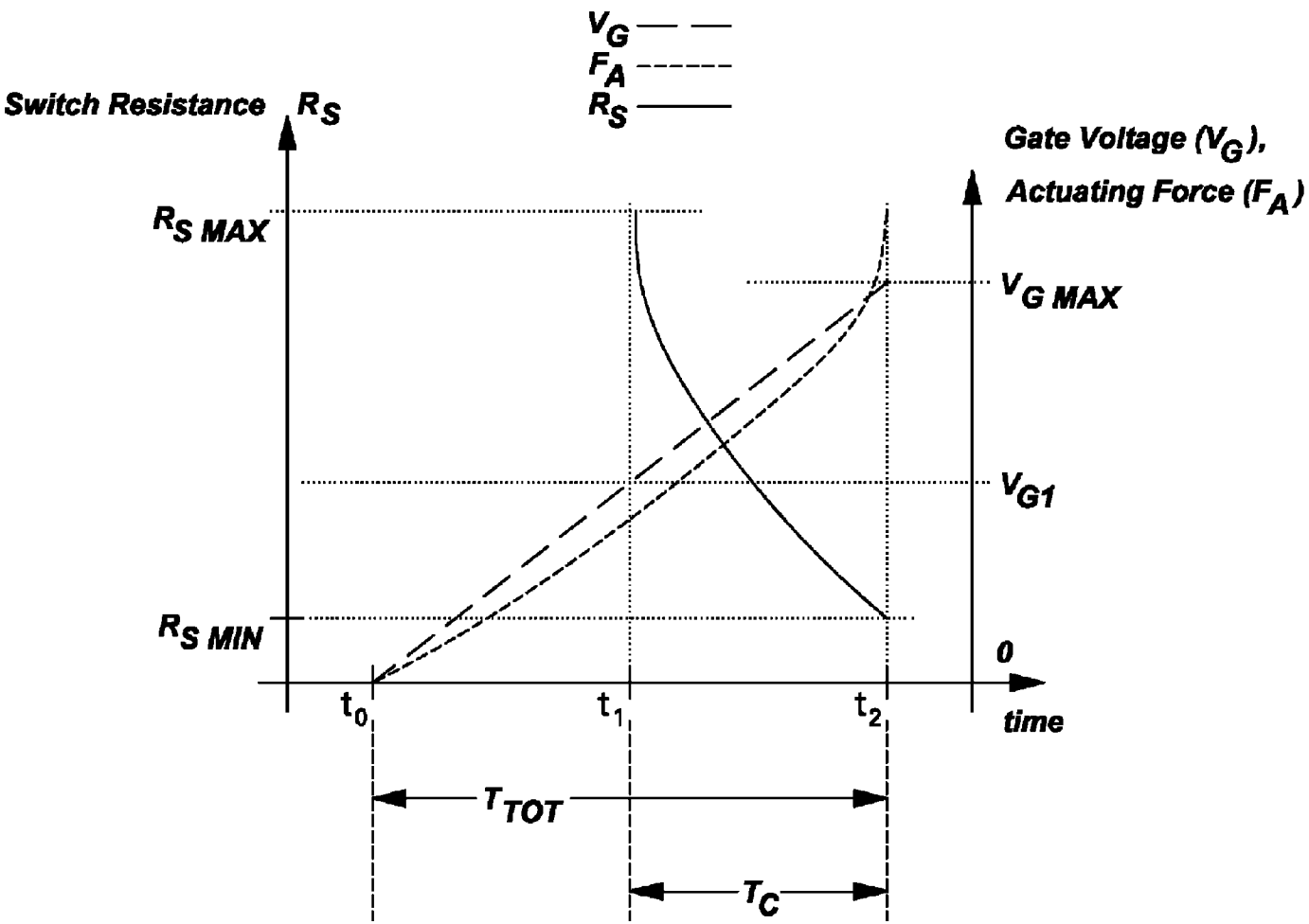
FIG. 6 is a plot of switch resistance, gate voltage, and actuating force as a function of time for the switch of FIG. 2.

Referring to FIGS. 1-6, the MEMS switch 102 can be configured to be selectively moveable between a non-contacting or "open" configuration or state, in which the beam 110 is separated from the contact 112 (e.g., as depicted in FIG. 3), and a contacting or "fully-closed" configuration or state, in which the beam makes maximum contact and establishes electrical communication with the contact (e.g., as depicted in FIG. 5). For example, the beam 110 can be configured to undergo deformation when moving between open and fully-closed configurations, such that the beam is naturally disposed (i.e., in the absence of externally applied forces) in a non-contacting configuration and may be deformed so as to occupy a contacting position while storing mechanical energy therein. In other embodiments, the undeformed configuration of the beam 110 may be the contacting configuration.

The MEMS switch 102 may include an electrode 116, which electrode may be in electrical communication with a gate voltage source 118. The gate voltage source 118 may provide a gate voltage $V_G$ to the electrode, thereby supplying charge to the electrode. As the electrode 116 is charged, a potential difference is established between the electrode and the beam 110, and an electrostatic actuating force $F_A$ can act to pull the beam towards the electrode (and also towards, and ultimately into contact with, the contact 112).

The gate voltage $V_G$ may vary from zero at a time $t_0$ to a value of $V_{G1}$ at a time $t_1$. The electrostatic actuating force $F_A$ can vary (although not necessarily linearly) with the gate voltage $V_G$. As the gate voltage $V_G$ (and electrostatic actuating force $F_A$) increases, the actuating force causes the beam 110 to move toward the contact 112, and eventually (at time $t_1$ in FIG. 6) the actuating force (corresponding to a gate voltage of $V_{G1}$ in FIG. 6) reaches a magnitude sufficient to cause the beam to deform so as to just allow electrical communication between the beam and the contact. This will nominally occur when the beam 110 contacts the contact 112, but may actually occur before the beam and contact are in contact, as the separation between the two may be small enough to allow for electrical communication across any physical gap that may separate the beam and contact (e.g., via field emission). In any event, at time $t_1$, the characteristic switch resistance $R_S$ (the effective resistance presented by the beam 110 and contact 112) goes from essentially infinity (the value of $R_S$ in the time period from $t_0$ to $t_1$ when the beam is spaced apart from the contact) to some large but finite value $R_{SMAX}$. In embodiments where the electromechanical switch structure includes an array of electromechanical switches, it should be understood that the characteristic switch resistance is equivalent to the effective resistance of the switch array (i.e., the resistance as would be found if the switch array were replaced by a single equivalent resistor).

The gate voltage $V_G$ may continue to increase to a maximum value of $V_{GMAX}$ at a time $t_2$. As the gate voltage $V_G$ increases, the actuation force $F_A$ will also increase, urging the beam 110 into more extensive contact with the contact 112. Correspondingly, the characteristic switch resistance $R_S$ will decrease over the time from $t_1$ to $t_2$ from $R_{SMAX}$ to a minimum value of $R_{SMIN}$. The minimum value of the characteristic switch resistance $R_S$ for the switch 102 is indicative of the fully-closed configuration of the switch, with other configurations of the switch (e.g., the configuration of FIG. 4, referred to as "partially closed" or, conversely, "partially open") being characterized by higher resistance values.

As mentioned above, when the switch 102 is in the fully-closed configuration, the beam 110 makes maximum contact with the contact 112. It is noted that the term "maximum contact," in this case, refers to the greatest amount of contact that is actually made between the beam and contact, and not the greatest possible amount of contact between those two structures. It may often be true that the beam 110 and contact 112 can be brought into greater contact by increasing the gate voltage $V_G$ applied to the electrode 116. In embodiments where the switch 102 includes an array of switches, the fully-closed configuration refers to the situation in which all of the switches in the array are closed to the maximum extent, while the partially-closed configuration is indicative of the situation in which at least one switch of the switch array is not fully-closed. For example, the switch array can include one or more contacts and one or more moveable elements, with each of the moveable elements being in maximum contact with at least one associated contact when the overall electromechanical switch structure is disposed in the fully-closed configuration and each of the moveable elements being separated from an associated contact when the electromechanical switch structure is disposed in the open configuration.

During a switching event (i.e., a movement of the switch 102 from a non-conducting state to a conducting state or vice versa), the gate voltage $V_G$ may be varied over a switching event time $T_{TOT}$ that is equal to $t_2-t_0$. However, the switch 102 may be configured to move from an open configuration (a configuration in which the beam 110 and the contact 112 are separated just enough to substantially preclude electrical communication therebetween) to the fully-closed configuration over a characteristic time $T_C$ that is equal to $t_2-t_1$. For switching events in which the switch 102 is being opened, the gate voltage $V_G$ would be decreased instead of increased. In the case where the switch 102 includes a switch array, the characteristic time $T_C$ may refer to the time between when the first switch of the array just closes and when all of the switches of the array are closed to the maximum extent. In embodiments where the electromechanical switch structure includes an array of electromechanical switches, the "characteristic time" associated with the switch array is the time required to move from a configuration of the switches in which a minimum effective array resistance is realized to a configuration in which the effective array resistance is infinite (e.g., for two switches in parallel, the longer of the opening times associated with each of the switches, for two switches in series, the shorter of the opening times).

Referring again to FIG. 1, a commutation circuit 120 can be connected in parallel with the switch 102. The commutation circuit 120 can include a balanced diode bridge 122 having a first branch 124 and a second branch 126. As used herein, the term "balanced diode bridge" is used to represent a diode bridge that is configured such that voltage drops across both the first and second branches 124, 126 are substantially equal. The first branch 124 of the balanced diode bridge 122 may include a first diode 128 and a second diode 130 coupled together in series circuit. In a similar fashion, the second branch 126 may include a third diode 132 and a fourth diode 134 operatively coupled together in series.

A voltage snubber circuit 136 may be coupled in parallel with the switch 102 and configured to limit voltage overshoot during fast contact separation. In certain embodiments, the snubber circuit 136 may include a snubber capacitor (not shown) coupled in series with a snubber resistor (not shown). The snubber capacitor may facilitate improvement in transient voltage sharing during the sequencing of the opening of the switch 102. Furthermore, the snubber resistor may suppress any pulse of current generated by the snubber capacitor during closing operation of the switch 102. In certain other embodiments, the voltage snubber circuit 136 may include a metal oxide varistor (MOV) (not shown).

The first MEMS switch 102 may be coupled in parallel across midpoints 138, 140 of the balanced diode bridge 122. A first midpoint 138 may be located between the first and second diodes 128, 130, and a second midpoint 140 may be located between the third and fourth diodes 132, 134.

The commutation circuit 120 can also include a pulse circuit 142 coupled in operative association with the balanced diode bridge 122. The pulse circuit 142 may be configured to detect a switch condition and initiate a switching event (an opening or closing of the switch 102 responsive to the switch condition. As used herein, the term "switch condition" refers to a condition that triggers changing a present operating state of the switch 102. A switch condition may occur in response to a number of actions including but not limited to a circuit fault or switch ON/OFF request.

The pulse circuit 142 may include a pulse switch 144 and a pulse capacitor 146 coupled together in series, the pulse capacitor having a capacitance $C_{PULSE}$. The pulse circuit 142 may also include a first diode 148 coupled in series with the pulse switch 144, and the pulse circuit may be characterized by a pulse inductance $L_{PULSE}$. The pulse capacitor 146 can be configured to form a pulse signal for inducing a pulse current $I_{PULSE}$ through the balanced diode bridge 122. The pulse signal could be generated, for example, in connection with a switching event of the switch 102. The pulse inductance $L_{PULSE}$, the diode 148, the pulse switch 144, and the pulse capacitor 146 may be coupled in series to form a first branch of the pulse circuit 142, where the components of the first branch may be configured to facilitate pulse current shaping and timing.

Referring to FIGS. 2 and 7-10, as discussed further below, in operation, the balanced diode bridge 122 can be configured to suppress arc formation between contacts (e.g., the beam 110 and the contact 112) of the switch 102. In some embodiments, this may enable the MEMS switch 102 to be rapidly switched (e.g., on the order of picoseconds or nanoseconds) from a closed state to an open state while carrying a current (albeit at a near-zero voltage).

Figure 7:
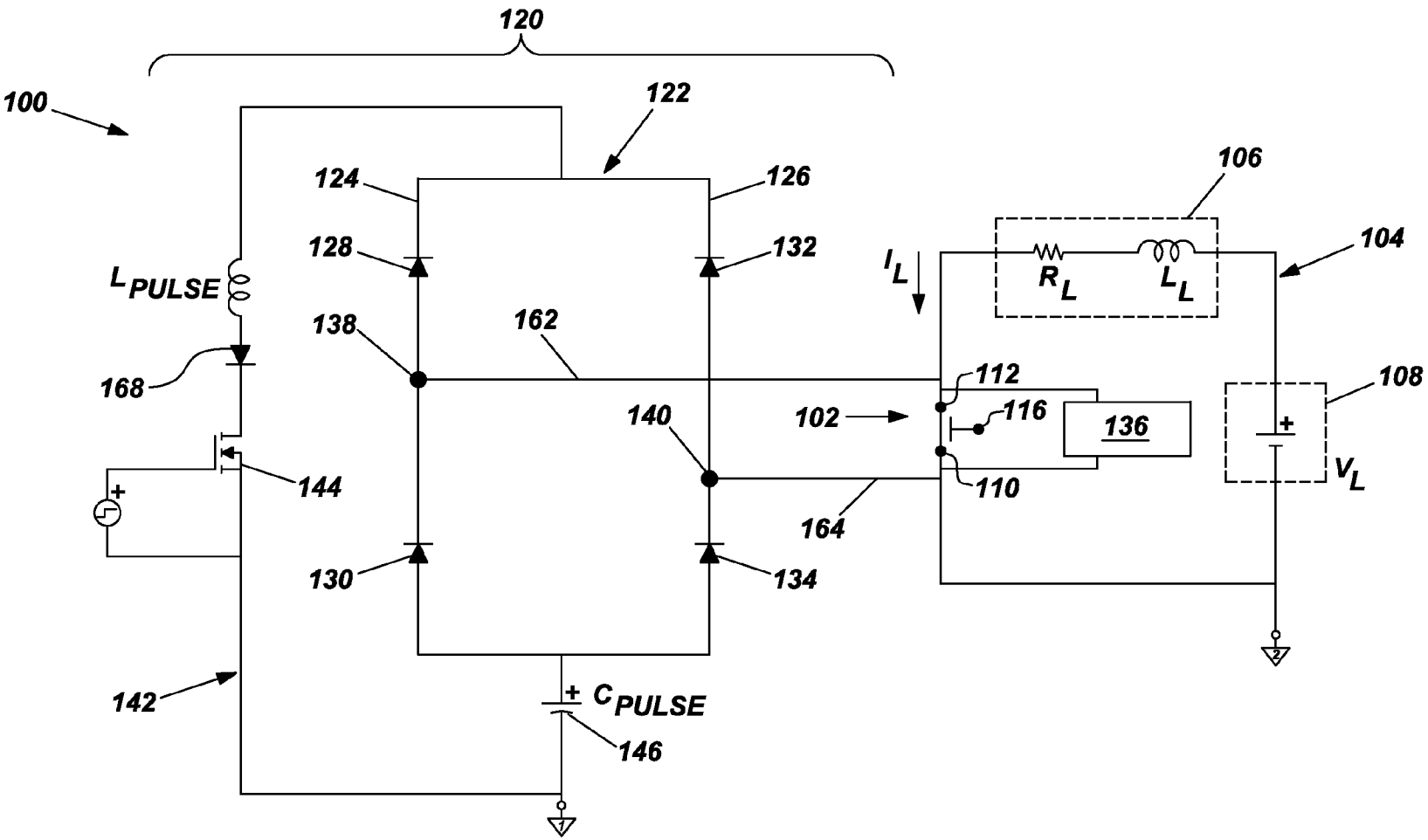
FIGS. 7-10 are schematic views representing an example operation of the switch module of FIG. 1.

FIGS. 7-10 are used as schematic flow charts to illustrate an example operation of the switch module 100. An initial condition of the example operation of the switch module 100 is illustrated in FIG. 7. The switch 102 is depicted as starting in a fully-closed configuration, and a load current h, which has a value substantially equal to $V_L/R_L$, is present in the load circuit 104.

Moreover, for discussion of this example operation, it may be assumed that the characteristic resistance $R_{SMIN}$ associated with the MEMS switch 102 in the fully-closed configuration is sufficiently small such that the voltage produced by the load current through the resistance of MEMS switch has only a negligible effect on the near-zero voltage difference between the mid-points 138, 140 of the diode bridge 122 when pulsed. For example, the characteristic resistance $R_{SMIN}$ associated with the fully-closed MEMS switch 102 may be assumed to be sufficiently small so as to produce a voltage drop of less than a few millivolts due to the maximum anticipated load current.

It may be noted that in this initial condition of the switch module 100, the pulse switch 144 is in a first open state. Additionally, there is no current in the pulse circuit 142 (i.e., $I_{PULSE}=0$). Also, in the pulse circuit 142, the capacitor 146 may be pre-charged to a voltage $V_{PULSE}$, where $V_{PULSE}$ is a voltage that can produce a half sinusoid of pulse current having a peak magnitude significantly greater (e.g., twice) the anticipated load current $I_L$ during the transfer interval of the load current. It may be noted that $C_{PULSE}$ and $L_{PULSE}$ may be selected so as to induce resonance in the pulse circuit 142.

Figure 8:
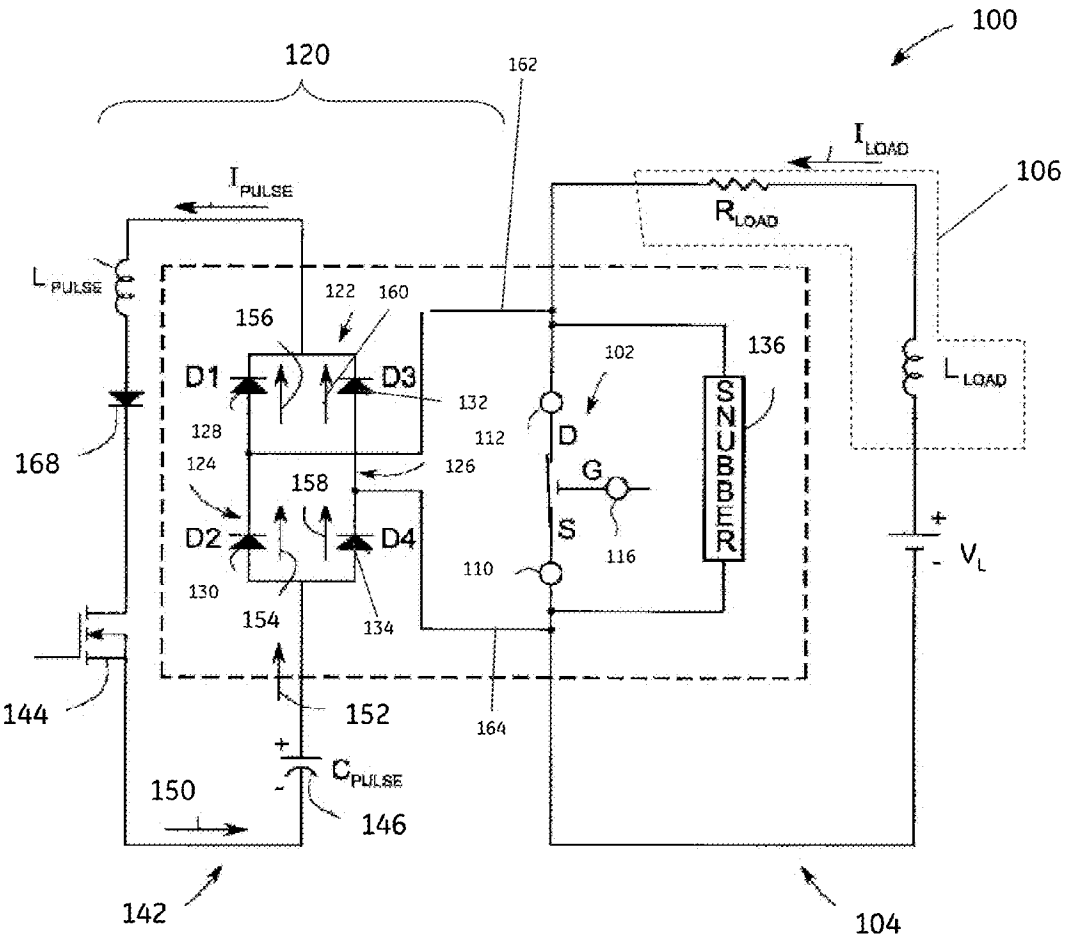

FIG. 8 schematically depicts a process of triggering the pulse circuit 142. It may be noted that detection circuitry (not shown) may be coupled to the pulse circuit 142. The detection circuitry may include sensing circuitry (not shown) configured to sense a level of the load circuit current $I_L$ and/or a value of the voltage level $V_L$, for example. Furthermore, the detection circuitry may be configured to detect a switch condition as described above. In one embodiment, the switch condition may occur due to the current level and/or the voltage level exceeding a predetermined threshold.

The pulse circuit 142 may be configured to detect the switch condition to facilitate switching the present fully-closed configuration of the switch 102 to an open configuration. In one embodiment, the switch condition may be a fault condition generated due to a voltage level or load current in the load circuit 104 exceeding a predetermined threshold level. However, as will be appreciated, the switch condition may also include monitoring a ramp voltage to achieve a given system-dependent ON time for the MEMS switch 102.

In one embodiment, the pulse switch 144 may generate a sinusoidal pulse responsive to receiving a trigger signal as a result of a detected switching condition. The triggering of the pulse switch 144 may initiate a resonant sinusoidal pulse current $I_{PULSE}$ in the pulse circuit 142. The current direction of the pulse current $I_{PULSE}$ may be represented by reference numerals 150 and 152. Furthermore, the current direction and relative magnitude of the pulse current $I_{PULSE}$ through the first diode 128 and the second diode 130 of the first branch 124 of the balanced diode bridge 122 may be represented by current vectors 154 and 156, respectively. Similarly, current vectors 158 and 160 are representative of a current direction and relative magnitude of the pulse circuit current through the third diode 132 and the fourth diode 134, respectively.

The value of the peak sinusoidal bridge pulse current may be determined by the initial voltage on the pulse capacitor 146, the value $C_{PULSE}$ of the pulse capacitor, and the inductance value $L_{PULSE}$ of the pulse circuit 142. The values for $C_{PULSE}$ and $L_{PULSE}$ also determine the pulse width of the half sinusoid of pulse current $I_{PULSE}$. The bridge current pulse width may be adjusted to meet the system load current turn-off requirement predicated upon the rate of change of the load current $I_L$ and the desired peak let-through current during a load fault condition. The pulse switch 144 may be configured to be in a conducting state prior to opening the MEMS switch 102.

It may be noted that triggering of the pulse switch 144 may include controlling a timing of the pulse current $I_{PULSE}$ through the balanced diode bridge 122 to facilitate creating a lower impedance path as compared to the impedance of a path through the contacts (e.g., the beam 110 and the contact 112) of the MEMS switch 102 during a switching event. In addition, the pulse switch 144 may be triggered such that a desired voltage drop is presented across the contacts of the MEMS switch 102.

In one embodiment, the pulse switch 144 may be a solid-state switch that may be configured to have switching speeds in the range of nanoseconds to microseconds, for example. The switching speed of the pulse switch 144 should be relatively fast compared to the anticipated rise time of the load current in a fault condition. The current rating of the MEMS switch 102 is dependent on the rate of rise of the load current $I_L$, which in turn is dependent on the inductance $L_L$ and the supply voltage $V_L$ in the load circuit 104 as previously noted. The MEMS switch 102 may be appropriately rated to handle a larger load current $I_L$ if the load current $I_L$ may rise rapidly compared to the speed capability of the pulse circuit 142.

The pulse current $I_{PULSE}$ can increase from a value of zero and divide equally between the first and second branches 124, 126 of the balanced diode bridge 122. In accordance with one embodiment, the difference in voltage drops across the branches 124, 126 of the balanced diode bridge 122 may be designed to be negligible, as previously described. Further, as previously described, the diode bridge 122 can be balanced such that the voltage drop across the first and second branches 124, 126 of the diode bridge 122 are substantially equal. Moreover, as the resistance of the MEMS switch 102 in a present fully-closed state is relatively low, there is a relatively small voltage drop across the MEMS switch. However, if the voltage drop across the MEMS switch 102 happened to be larger (e.g., due to an inherent design of the MEMS switch), the balancing of the diode bridge 122 may be affected as the diode bridge is operatively coupled in parallel with the MEMS switch. If the resistance of the MEMS switch 102 causes a significant voltage drop across the MEMS switch, then the diode bridge 122 may accommodate the resulting imbalance by increasing the magnitude of the peak bridge pulse current.

Figure 9:
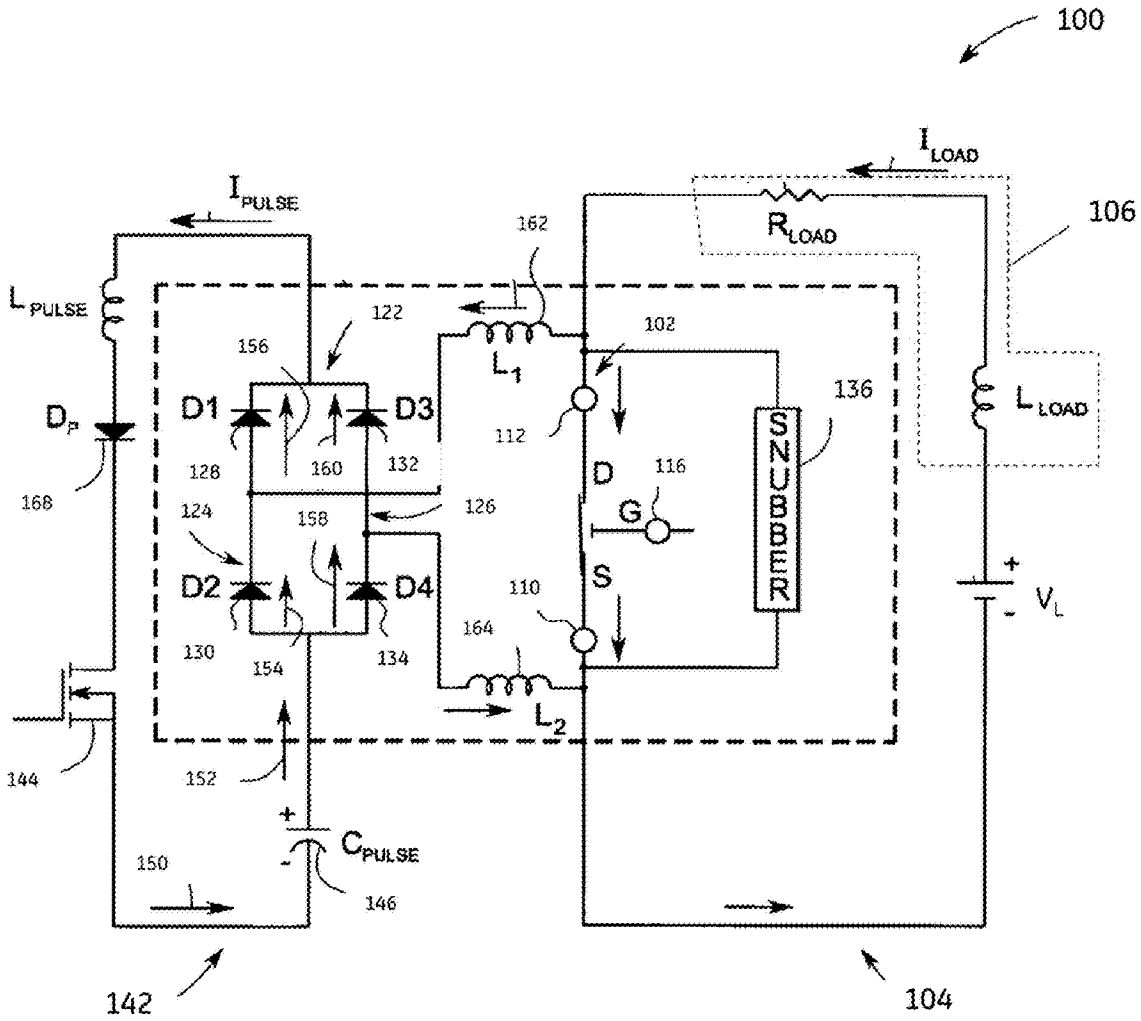

Referring now to FIG. 9, therein is a schematic depiction in which opening of the MEMS switch 102 is initiated. As previously noted, the pulse switch 144 in the pulse circuit 142 is triggered prior to opening the MEMS switch 102. As the pulse current $I_{PULSE}$ increases, the voltage across the pulse capacitor 146 decreases due to the resonant action of the pulse circuit 142. In the ON condition in which the MEMS switch 102 is fully-closed and conducting, the MEMS switch presents a path of relatively low impedance for the load circuit current $I_L$.

Once the amplitude of the pulse current $I_{PULSE}$ becomes greater than the amplitude of the load circuit current $I_L$ (e.g., due to the resonant action of the pulse circuit 142), a gate voltage can be applied to the MEMS switch 102 to switch the present operating state of the MEMS switch from the fully-closed and conducting state to an increasing resistance condition in which the MEMS switch starts to open and turn off (e.g., where the beam 110 still contacts the contact 112 but contact pressure between the two is diminishing due the switch opening process). This causes the characteristic switch resistance to increase, which in turn causes the load current $I_L$ to start to divert from the MEMS switch 102 into the commutation circuit 120.

In this present condition, the balanced diode bridge 122 presents a path of relatively low impedance to the load current $I_L$ as compared to a path through the MEMS switch 102, which is now associated with an increasing characteristic resistance. It may be noted that this diversion of load current $I_L$ through the MEMS switch 102 is an extremely fast process compared to the rate of change of the load circuit current $I_L$. As previously noted, it may be desirable that the inductances $L_1$ and $L_2$ respectively associated with the connections 162, 164 between the MEMS switch 102 and the balanced diode bridge 122 are small in order to avoid inhibition of the fast current diversion.

As the process of current transfer from the MEMS switch 102 to the commutation circuit 120 continues, the current in each of the first diode 128 and the fourth diode 134 increases, while, simultaneously, the current in each of the second diode 130 and the third diode 132 is diminished. The transfer process is completed when the contacts (e.g., the beam 110 and the contact 112) of the MEMS switch 102 are separated to form a physical gap therebetween and all of the load current $I_L$ is carried by the first diode 128 and the fourth diode 134.

Consequent to the load current $I_L$ being diverted from the MEMS switch 102 to the diode bridge 122 in direction 166, an imbalance forms across the first and second branches 124, 126 of the diode bridge. Furthermore, as the pulse current $I_{PULSE}$ decays, voltage across the pulse capacitor 146 continues to reverse (e.g., acting as a "back electromotive force") which causes the eventual reduction of the load circuit current $I_L$ to zero. The second diode 130 and the third diode 132 in the diode bridge 122 may then become reverse biased, which results in load current $I_L$ being directed through the pulse circuit 142, with the load current $I_L$ now interacting with the series resonant circuit characterized by the pulse inductance $L_{PULSE}$ and the capacitance $C_{PULSE}$ of the pulse capacitor 146.

Figure 10:
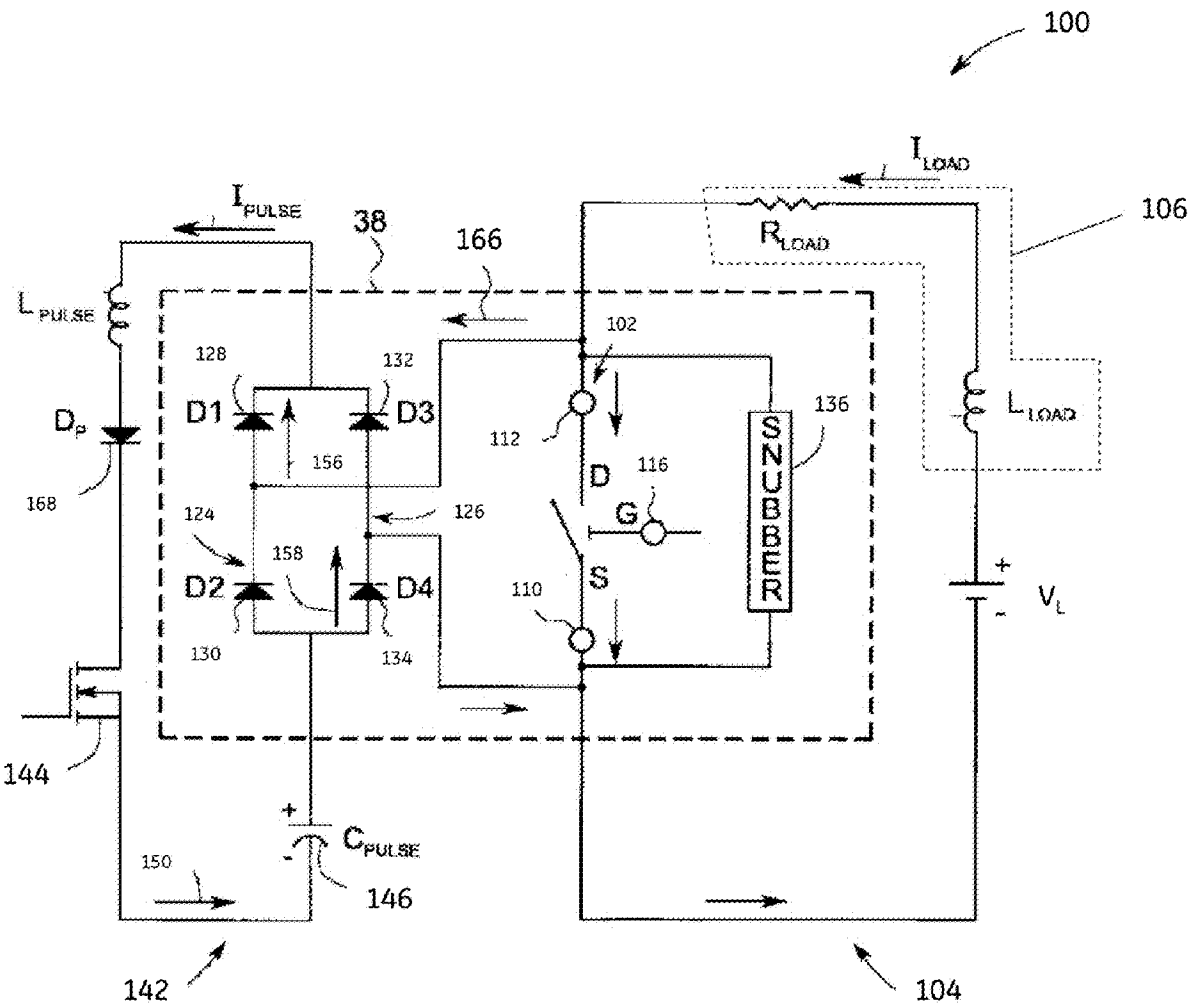

Turning now to FIG. 10, therein is a schematic depiction of the process of decreasing the load current $I_L$. At the instant that the contacts (e.g., the beam 110 and the contact 112) of the MEMS switch 102 part, infinite resistance is achieved. Furthermore, the diode bridge 122 no longer maintains a near-zero voltage across the contacts 110, 112 of the MEMS switch 102. Also, the load circuit current $I_L$ is now equal to the current through the first diode 128 and the fourth diode 134. As previously noted, there is now no current through the second diode 130 and the third diode 132.

Additionally, a voltage difference from the contact 112 to the beam 110 of the MEMS switch 102 may now rise to a maximum of approximately twice the voltage $V_L$ at a rate determined by the net resonant circuit which includes the pulse inductance $L_{PULSE}$, the capacitance $C_{PULSE}$ of the pulse capacitor 146, the load inductance $L_L$, and damping due to the load resistance $R_L$. Moreover, the pulse current $I_{PULSE}$, which is now equal to the load circuit current $I_L$, may resonantly decrease to a zero value and to maintain the zero value due to the reverse blocking action of the diode bridge 122 and the pulse circuit diode 168. The voltage across the pulse capacitor 146 has at this point reversed resonantly to a negative peak, which negative peak value will be maintained until the pulse capacitor is recharged.

The diode bridge 122 may be configured to maintain a near-zero voltage across the contacts 110, 112 of the MEMS switch 102 until the contacts separate to open the MEMS switch, thereby preventing damage by suppressing any arc that would tend to form between the contacts of the MEMS switch during opening. Additionally, the contacts 110, 112 of the MEMS switch 102 approach the opened state at a much reduced current through the MEMS switch. Also, any stored energy in the load inductance $L_L$, (including inductances in the load circuit 104 and the power source 108) may be transferred to the pulse capacitor 146 and may be absorbed via voltage dissipation circuitry (not shown). The voltage snubber circuit 136 may be configured to limit voltage overshoot during the fast contact separation due to inductive energy remaining in the interface between the bridge 122 and the MEMS switch 102. Furthermore, the rate of increase of reapply voltage across the contacts 110, 112 of the MEMS switch 102 during opening may be controlled via use of the snubber circuit 136.

Figure 11:
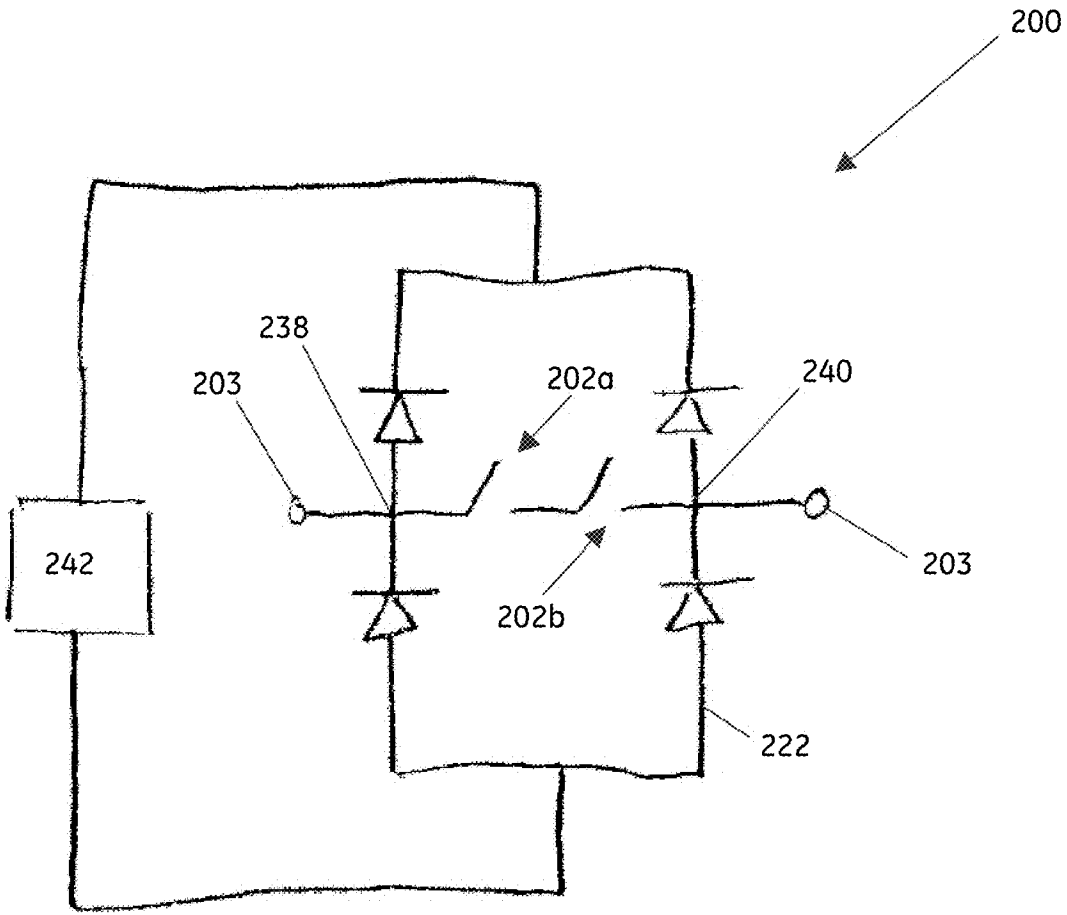
FIGS. 11-15 are schematic views of respective switch module configured in accordance with other example embodiments.
Figure 12:
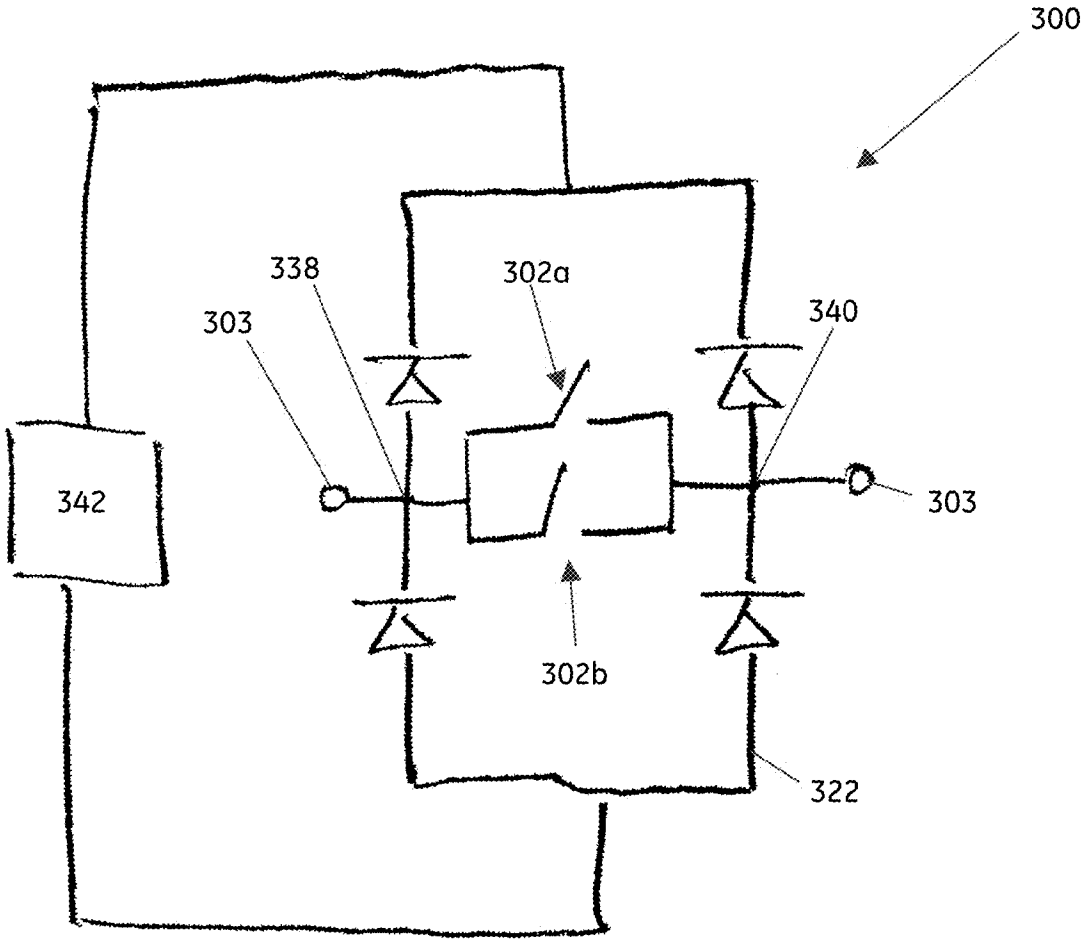
Figure 13:
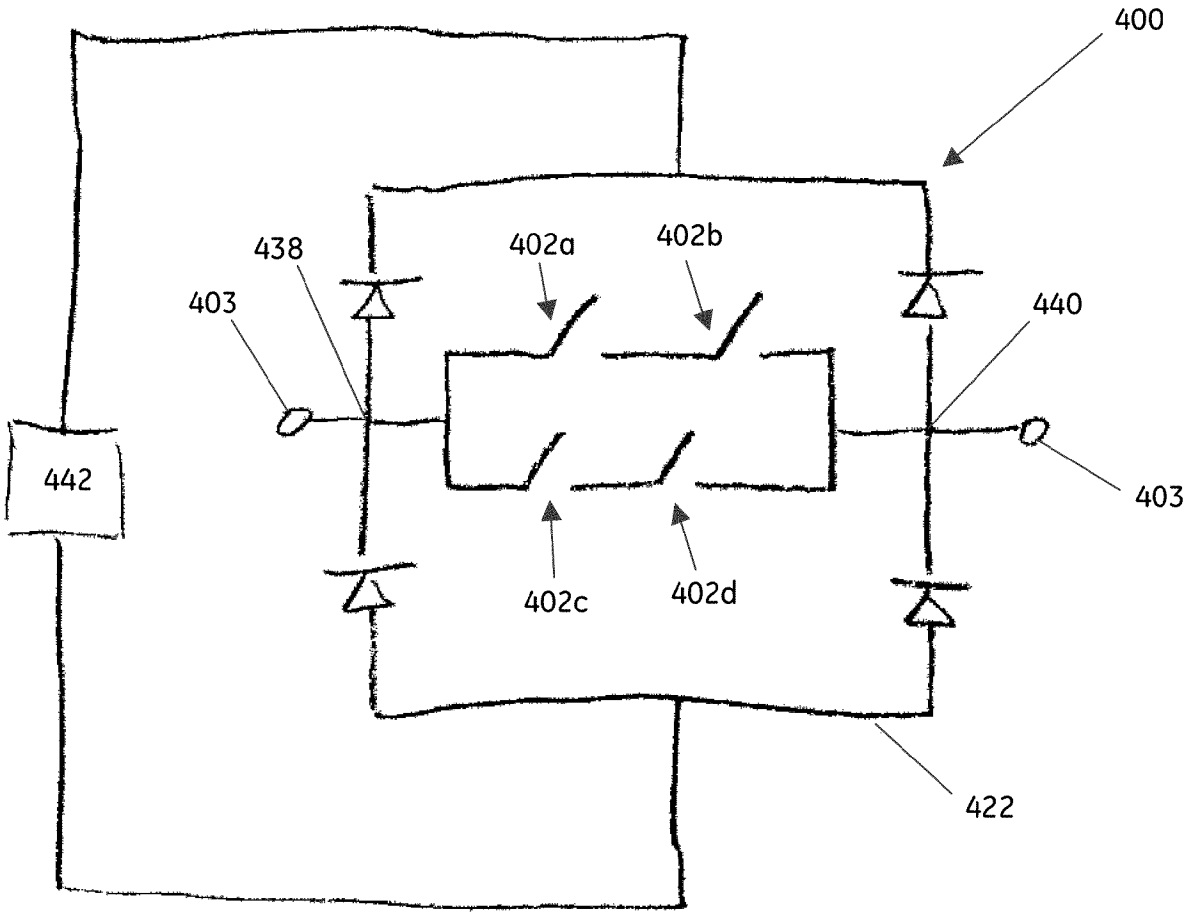

As mentioned above, embodiments of switch modules can employ electromechanical switches individually or as part of a switch array. For example, referring to FIG. 11, in one embodiment, a switch module 200 may include several electromechanical switches 202*a*, 202*b* arranged as an array and connected in series between the midpoints 238, 240 of a balanced diode bridge 222. A pulse circuit 242 can then be connected across the balanced diode bridge 222 as described above. Terminals 203 can be used to connect the switch module 200 to, say, a load circuit (not shown). Referring to FIG. 12, in another embodiment, a switch module 300 may include several electromechanical switches 302*a*, 302*b* arranged as an array and connected in parallel between the midpoints 338, 340 of a balanced diode bridge 322. Again, a pulse circuit 342 can be connected across the balanced diode bridge 322, and terminals 303 can be used to connect the switch module 300 to a load circuit (not shown). Referring to FIG. 13, in yet another embodiment, a switch module 400 may include several electromechanical switches 402*a*, 402*b*, 402*c*, 402*d* arranged as an array and connected both in series and in parallel between the midpoints 438, 440 of a balanced diode bridge 422. Again, a pulse circuit 442 can be connected across the balanced diode bridge 422, and terminals 403 can be used to connect the switch module 400 to a load circuit (not shown).

Referring again to FIG. 1, the commutation circuit 142 may be associated with a total inductance $L_{COM}$. The total commutation circuit inductance $L_{COM}$ may include, for example, the inductances $L_1$ and $L_2$ respectively associated with the connections 162, 164 between the MEMS switch 102 and the balanced diode bridge 122, the pulse circuit inductance $L_{PULSE}$, and the inductance $L_B$ associated with the balanced diode bridge 122. The MEMS switch 102 and the balanced diode bridge 122 can be disposed such that a total inductance $L_{COM}$ associated with the commutation circuit 142 is less than or equal to a product of the characteristic time for switch opening $T_C$ and the minimum characteristic switch resistance $R_{SMIN}$ (i.e., the switch resistance associated with a switch in the fully-closed configuration). As discussed below, configuring the switch module 100 in this way may help to avoid voltage surges across the switch 102.

In order to maintain the total inductance $L_{COM}$ less than or equal to the product $R_{SMIN} \cdot T_C$, the minimum characteristic switch resistance $R_{SMIN}$ and/or the characteristic time $T_C$ over which the switch 102 is opened can be increased. However, increasing the minimum characteristic switch resistance $R_{SMIN}$ may lead to increased energy losses in the switch module 100. Increasing the characteristic time $T_C$ over which the switch 102 is opened can result in more current being passed through the switch before opening, which may be unacceptable where the switch module is intended to divert fault current before it can reach a level sufficient to cause damage to a load. As such, in some embodiments, the switch 102 may be configured to move between open and fully-closed configurations over a characteristic time $T_C$ that is less than or equal to about 15 microseconds. For applications that allow for controlling the opening time for the switch 102, it may be desirable in some embodiments to control the opening of the switch so as to generate a constant voltage during current commutation into the bridge 122, at a voltage level that is just below what can be tolerated (i.e., $L_{COM}=R_{SMIN} \cdot T_C$). It is noted that a higher voltage may result in damage to the switch 102, and a lower voltage may unnecessarily require more time.

With the above limitations in mind, it may be desirable to maintain the inductance $L_{COM}$ associated with the commutation circuit 142 at a level less than or equal to the product $R_{SMIN} \cdot T_C$ by physically disposing the components of the commutation circuit (e.g., the diode bridge 122, the connections 162, 164, and the pulse circuit 142) so as to limit the area enclosed within the commutation circuit. For example, the MEMS switch 102 and the balanced diode bridge 122 may be packaged so as to be closely spaced to facilitate minimization of parasitic inductance caused by the balanced diode bridge and, in particular, the connections 162, 164 to the MEMS switch. In one embodiment, the MEMS switch 102 may be integrated with the balanced diode bridge 122, for example, in a single package or the same die. The inherent inductance between the MEMS switch 102 and the balanced diode bridge 122 may in this way produce a di/dt voltage less than a few percent of the voltage across the contacts 110, 112 of the MEMS switch when carrying a transfer of the load current to the diode bridge during turn-off switching event.

Figure 14:
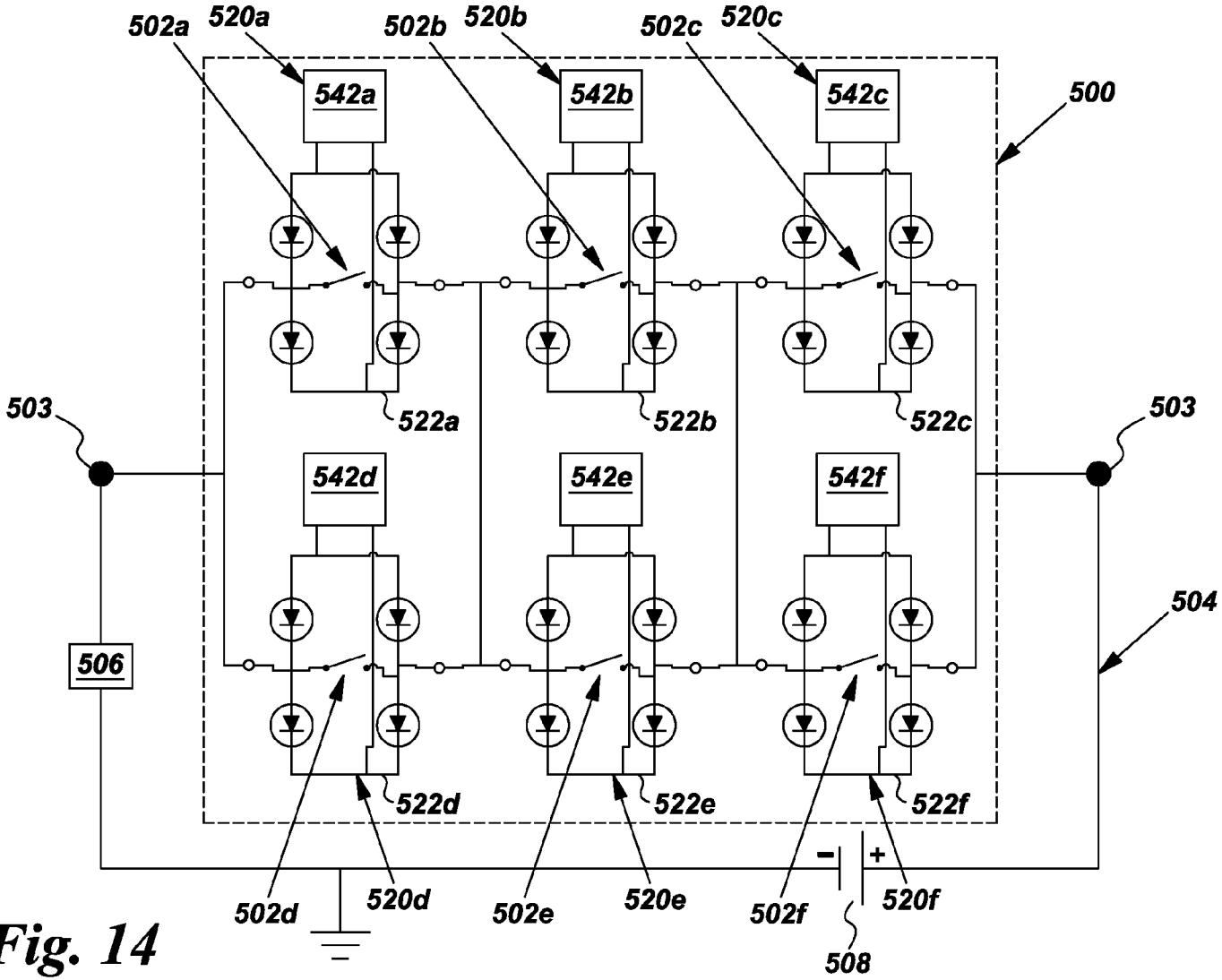

Referring to FIG. 14, therein is shown a switch module 500 configured in accordance with another example embodiment. The switch module 500 can include a first electromechanical switch structure 502*a*, a second electromechanical switch structure 502*b*, and third, fourth, fifth, and sixth electromechanical switch structures 502*c*, 502*d*, 502*e*, 502*f*, each of which may include one or an array of switches connected together in series, parallel, or both. Each of the electromechanical switch structures 502*a-f* can be configured to move between an open configuration and a fully-closed configuration (the latter being associated with a respective minimum characteristic switch resistance) over a respective characteristic time.

The electromechanical switch structures 502*a-f* can be configured to connect to a load circuit 504 in parallel with one another (e.g., see switch structures 502*a* and 502*d* in FIG. 14), in series with one another (e.g., see switch structures 502*a* and 502*b* in FIG. 14), or both. For example, the electromechanical switch structures 502*a-f* may be associated with terminals 503 that allow for the load circuit 504 to be connected across the switch structures. The load circuit 504 can include, for example, an electrical load 506 and a power source 508.

Each electromechanical switch structure 502*a-f* can be connected in parallel with a respective commutation circuit 520*a-f*. Each of the commutation circuits 520*a-f* can include a balanced diode bridge 522*a-f* configured to suppress arc formation between contacts of a respective one of the electromechanical switch structures 502*a-f*. Each of the commutation circuits 520*a-f* can also include a respective pulse circuit 542*a-f* configured to generate a pulse signal in connection with a switching event to cause pulse current to flow through the associated balanced diode bridge 522*a-f*. Each electromechanical switch structure 502*a-f* and associated balanced diode bridge 522*a-f* can be respectively disposed relative to one another such that, for each combination of electromechanical switch structure 502*a-f* and related commutation circuit 520*a-f* (e.g., switch 502*a* and commutation circuit 520*a* being one related combination, switch 502*b* and commutation circuit 520*b* being another related combination, etc.), a total inductance associated with the commutation circuit is less than or equal to a product of the characteristic time associated with the related switch and the minimum characteristic resistance of the related switch. In some embodiments, a voltage grading network (not shown) may also be included in the switch module 500.

Each switch/bridge/pulse circuit combination may operate independently of the others, with each pulse circuit being sized according to the acceptable voltage and current levels for the switch being respectively protected. By placing the diode bridges 522*a-f* (and associated diodes) as physically close as possible to the switches 502*a-f*, the stray inductance of the commutation loop may be reduced. Further, by providing a dedicated commutation circuit 520*a-f* for each electromechanical switch 502*a-f* (or set of electromechanical switches in the case where the electromechanical switch structure includes an array of switches), each switch/switch array may be protected from potentially damaging voltage surges. If each combination of a switch/switch array and its associated commutation circuit is considered a discrete module element, the switch module 500 can then be constructed by assembling module elements in varying configurations, with each element being configured so as to conform to the design rule that the inductance of the commutation circuit is less than or equal to the product of the minimum switch resistance and the characteristic opening time of the switch.

Figure 15:
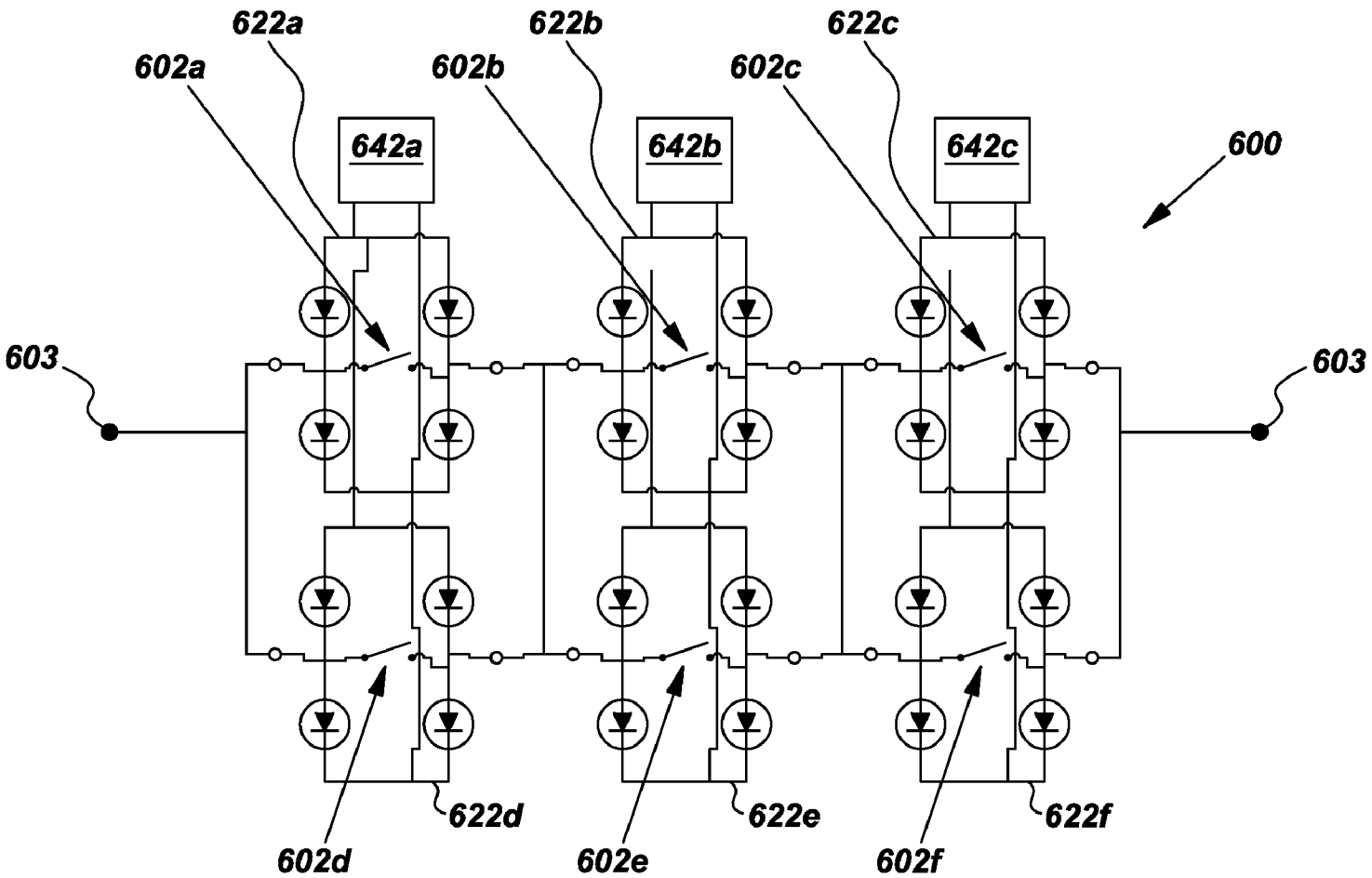

The switch module 500 includes a plurality of commutation circuits 520*a-f*. In some embodiments, it may be desirable to reduce the overall complexity of the switch module, for example, by consolidating some of the commutation circuits. Specifically, referring to FIG. 15, therein is shown a switch module 600 configured in accordance with another example embodiment. The switch module 600 can include a plurality of electromechanical switches 602*a-f* configured to connect, via terminals 603, to a load circuit (not shown) in parallel with one another (e.g., see switch structures 602*a* and 602*d* in FIG. 15) and in series with one another (e.g., see switch structures 602*a* and 602*b* in FIG. 15).

Each electromechanical switch structure 602*a-f* can be connected in parallel with a respective balanced diode bridge 622*a-f*. Further, for switches configured to be connected in parallel to an external load circuit (e.g., switch structures 602*a* and 602*d*, switch structures 602*b* and 602*e*, and switch structures 602*c* and 602*f* in FIG. 15), a respective pulse circuit 642*a-c* can be configured to generate a pulse signal, in connection with a switching event, to cause pulse current to flow through the appropriate balanced diode bridge 622*a-f* for the associated switches 602*a-f*.

Each electromechanical switch structure 602*a-f* and associated balanced diode bridge 622*a-f* can be respectively disposed relative to one another such that, for each combination of electromechanical switch structure 602*a-f* and related balanced diode bridge 622*a-f* and pulse circuit 642*a-c* (e.g., switch 602*a*, balanced diode bridge 622*a*, and pulse circuit 642*a* being one related combination; switch 602*b*, balanced diode bridge 622*b*, and pulse circuit 642*b* being another related combination; switch 602*d*, balanced diode bridge 622*d*, and pulse circuit 642*a* being yet another related combination, etc.), a total inductance associated with the pulse circuit/balanced diode bridge combination is less than or equal to a product of the characteristic time and the minimum characteristic resistance for the related switch.

Again, in some embodiments, it may be desirable to connect each diode bridge 622*a-f* so as to be physically disposed as close as possible to the respectively associated switches 602*a-f* in order to minimize the resulting stray inductance. Further, operation of a single pulse circuit 642*a-c* applies a pulse of current to all of the diode bridges that are connected thereto (e.g., in the embodiment depicted in FIG. 15, a pulse from pulse circuit 642*a* supplies current to diode bridges 622*a* and 622*d*). The total pulse current is distributed approximately evenly amongst all of diode bridges connected thereto, and the current capacity of each diode bridge can be sized according to the load current to be carried by the associated switch. The voltage rating of each diode bridge 622*a-f* and each pulse circuit 642*a-c* can be determined by the voltage rating of a single switch.

Referring to FIG. 1, overall, the balanced diode bridge 122 can afford switching protection for the associated MEMS switch 102 during switching events. By [configuring the switch 102 and the balanced diode bridge 122 such that a total inductance associated with the commutation circuit 142 is less than or equal to a product of the characteristic time and the minimum characteristic resistance for the switch, damaging voltage surges upon opening of the switch due to stray inductance may, in some embodiments, be mitigated. For example, referring to FIG. 16, therein is shown the applicable equivalent circuit 700 associated with the switch module 100 of FIG. 1, the equivalent circuit representing operation of the switch module during the time that the switch 102 (FIG. 1) is opening while being protected by the commutation circuit 142 (FIG. 1).

Figure 16:
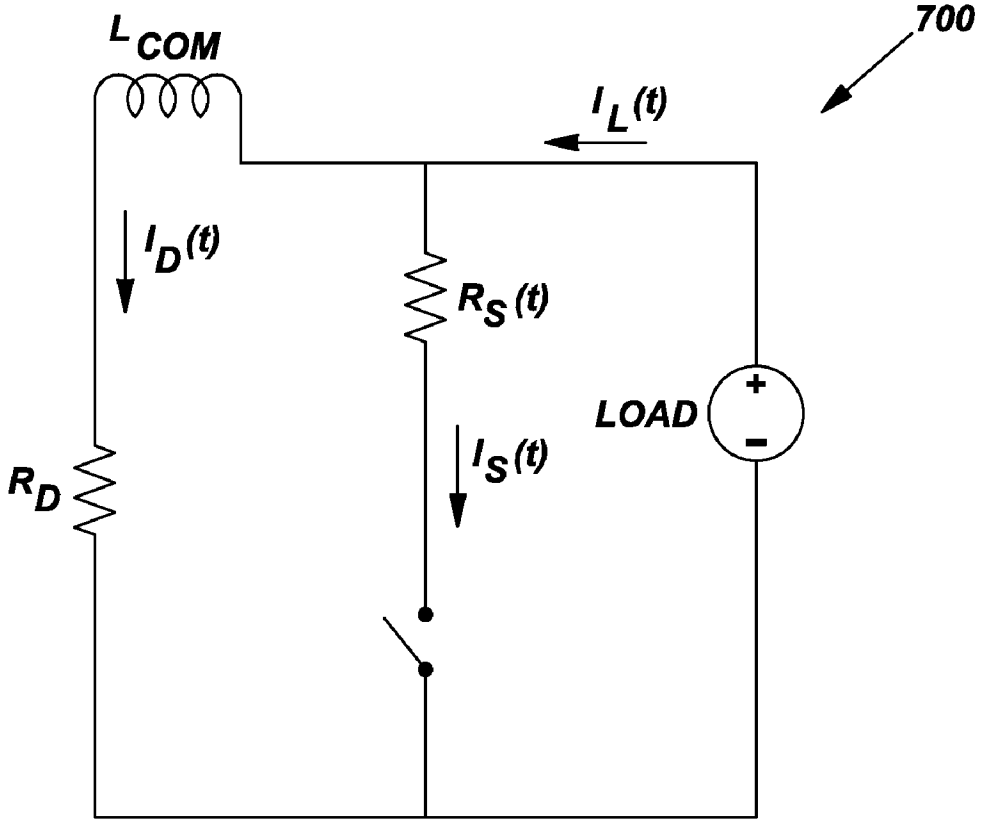
FIG. 16 is a schematic view of an equivalent circuit for the switch module of FIG. 1.
Figure 1:
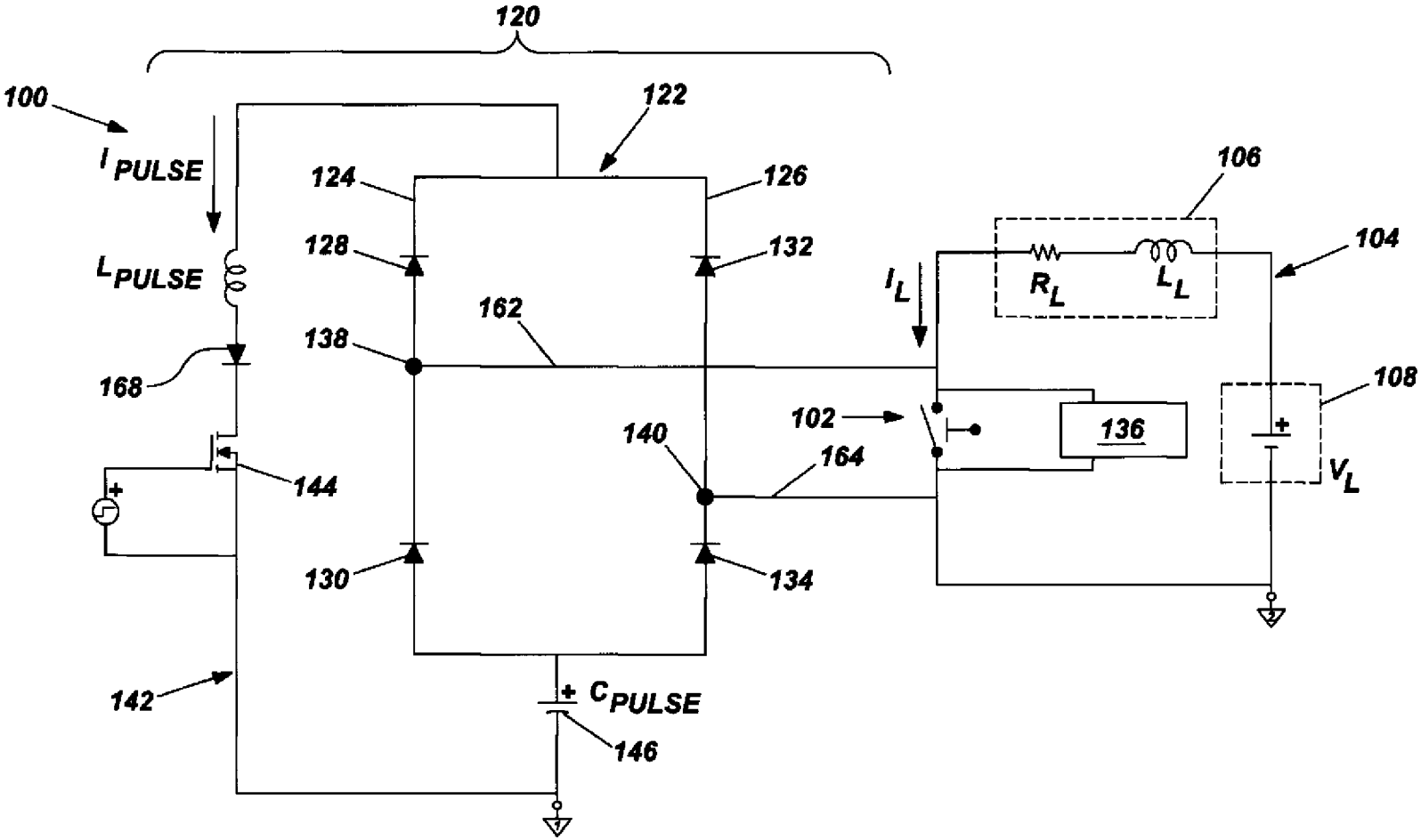
Figure 3:
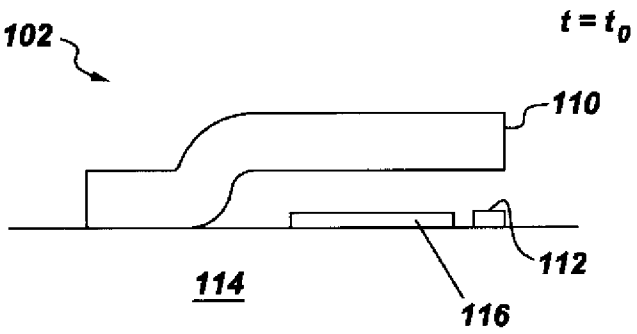
Figure 2:
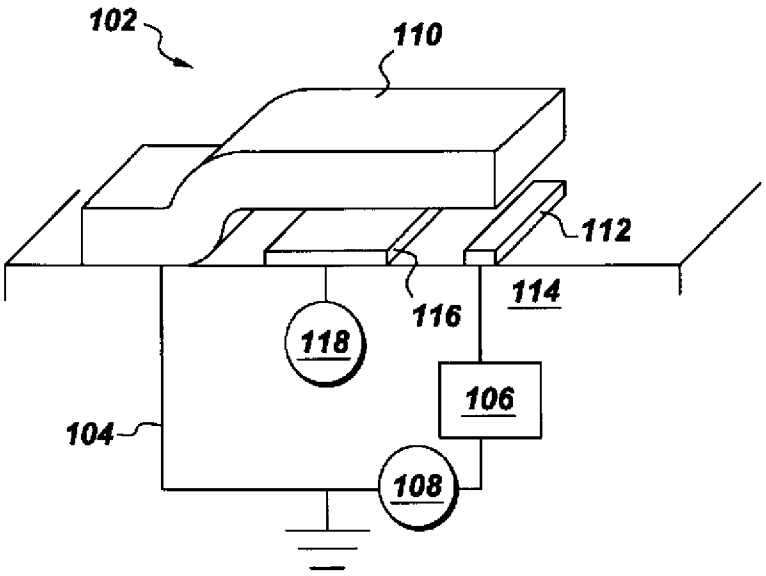
Figure 5:
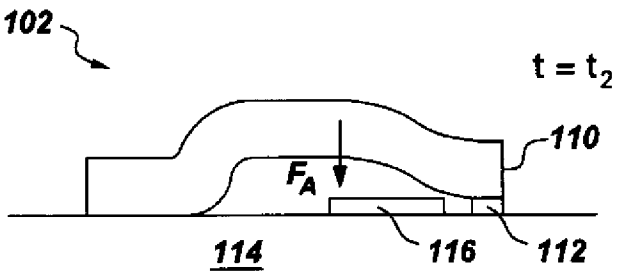
Figure 4:
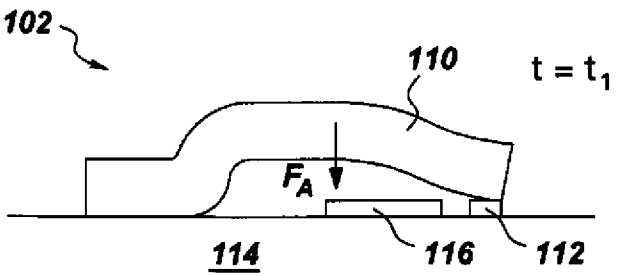
Figure 6:
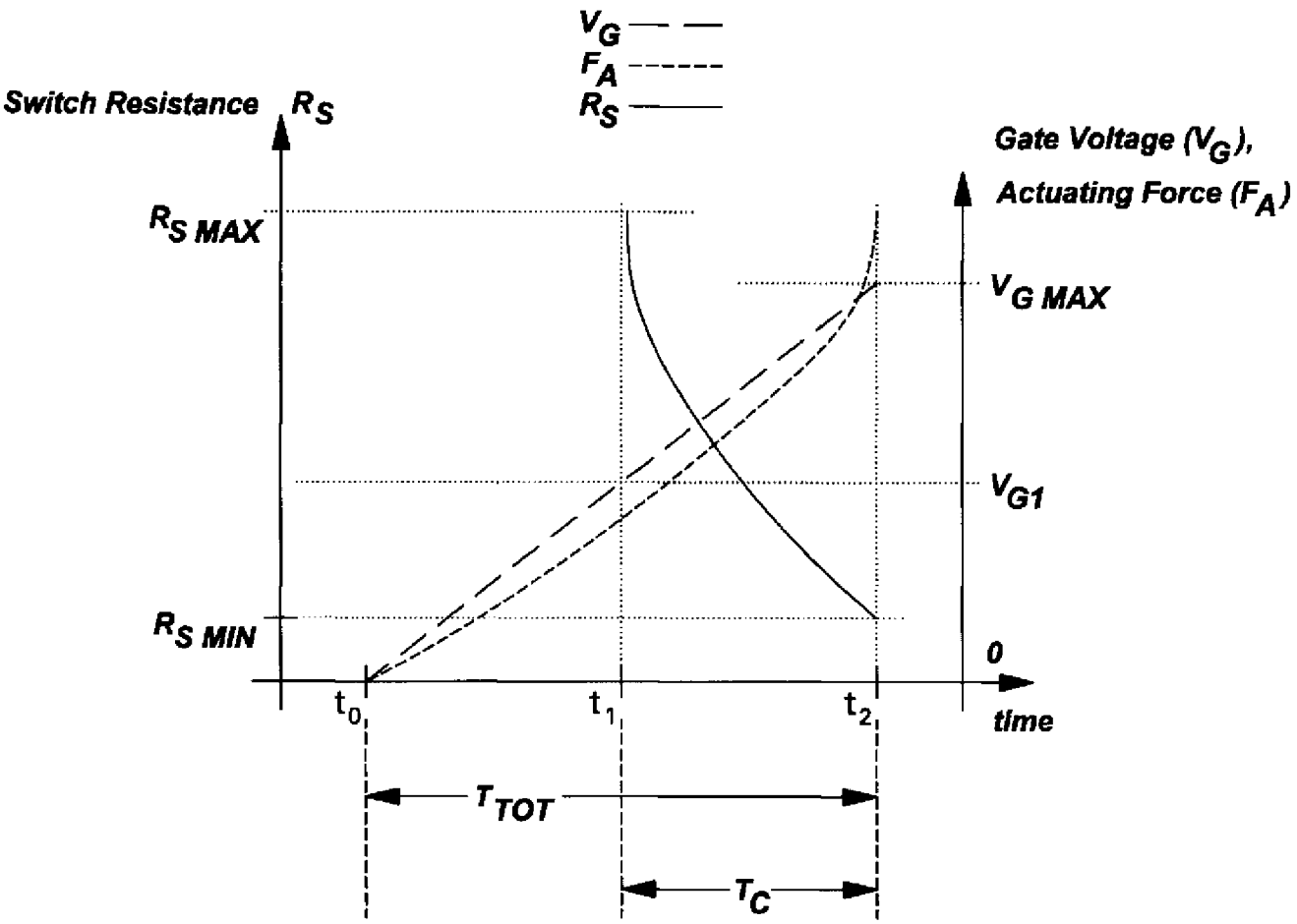
Figure 7:
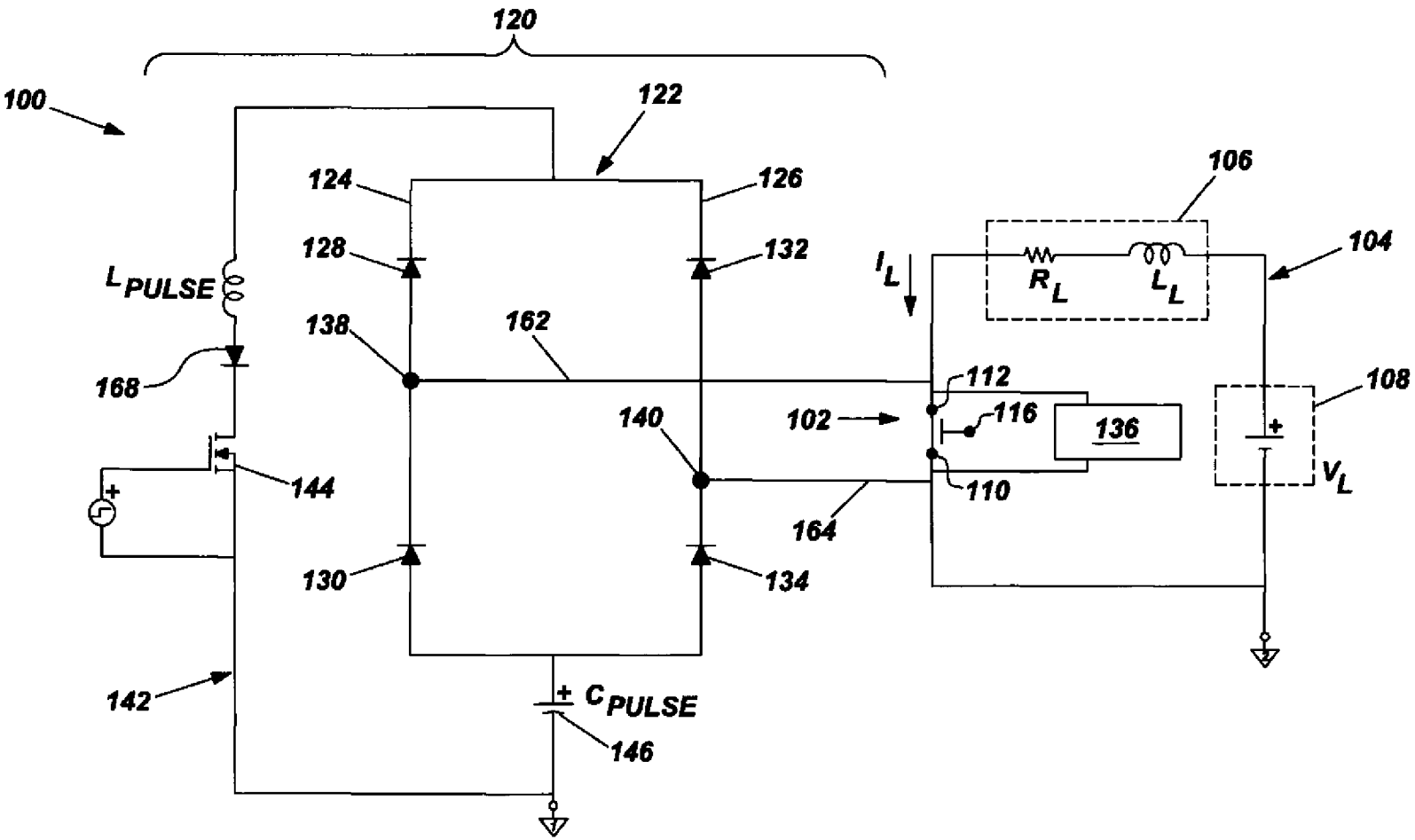
Figure 8:
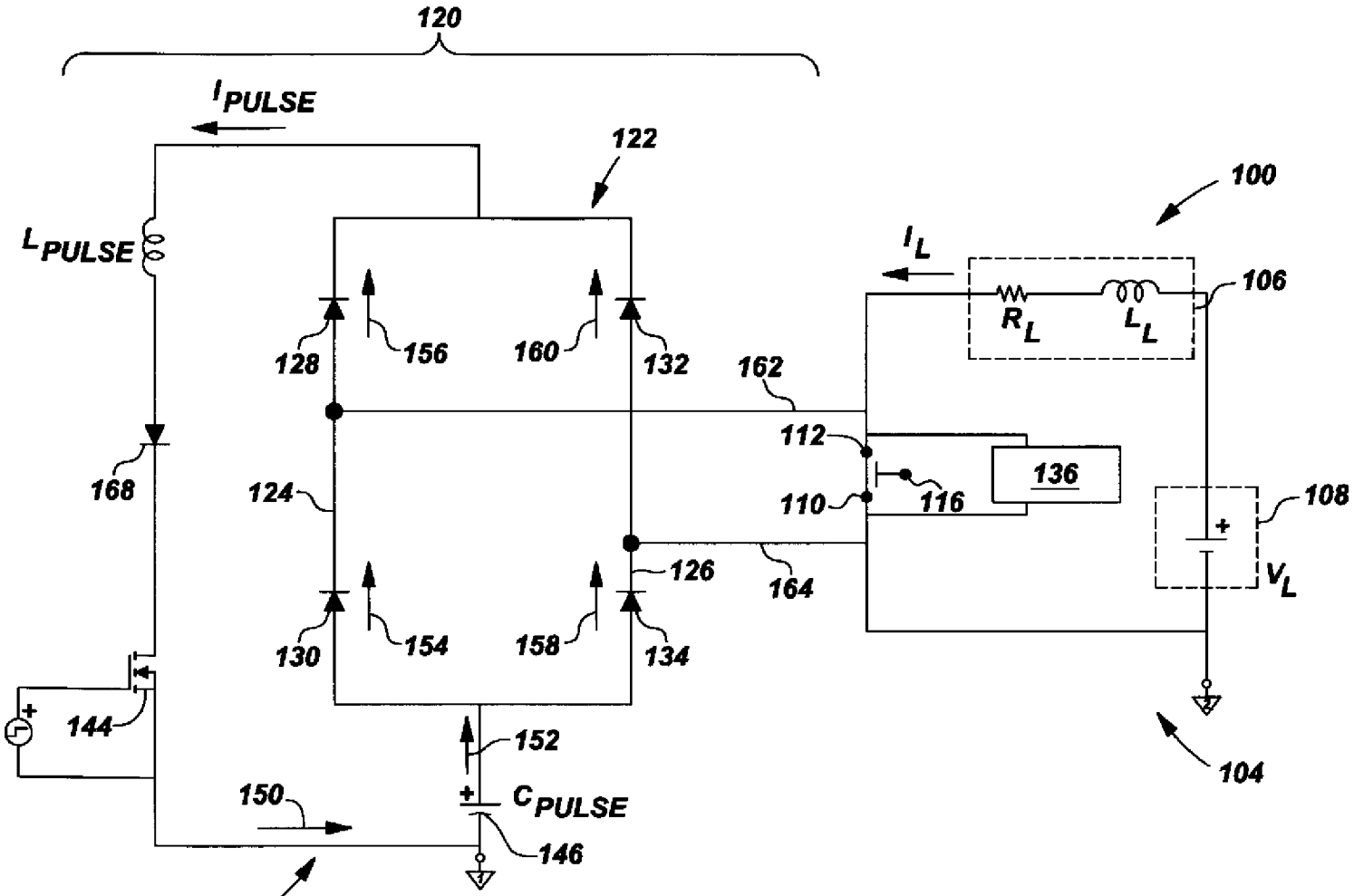
Figure 9:
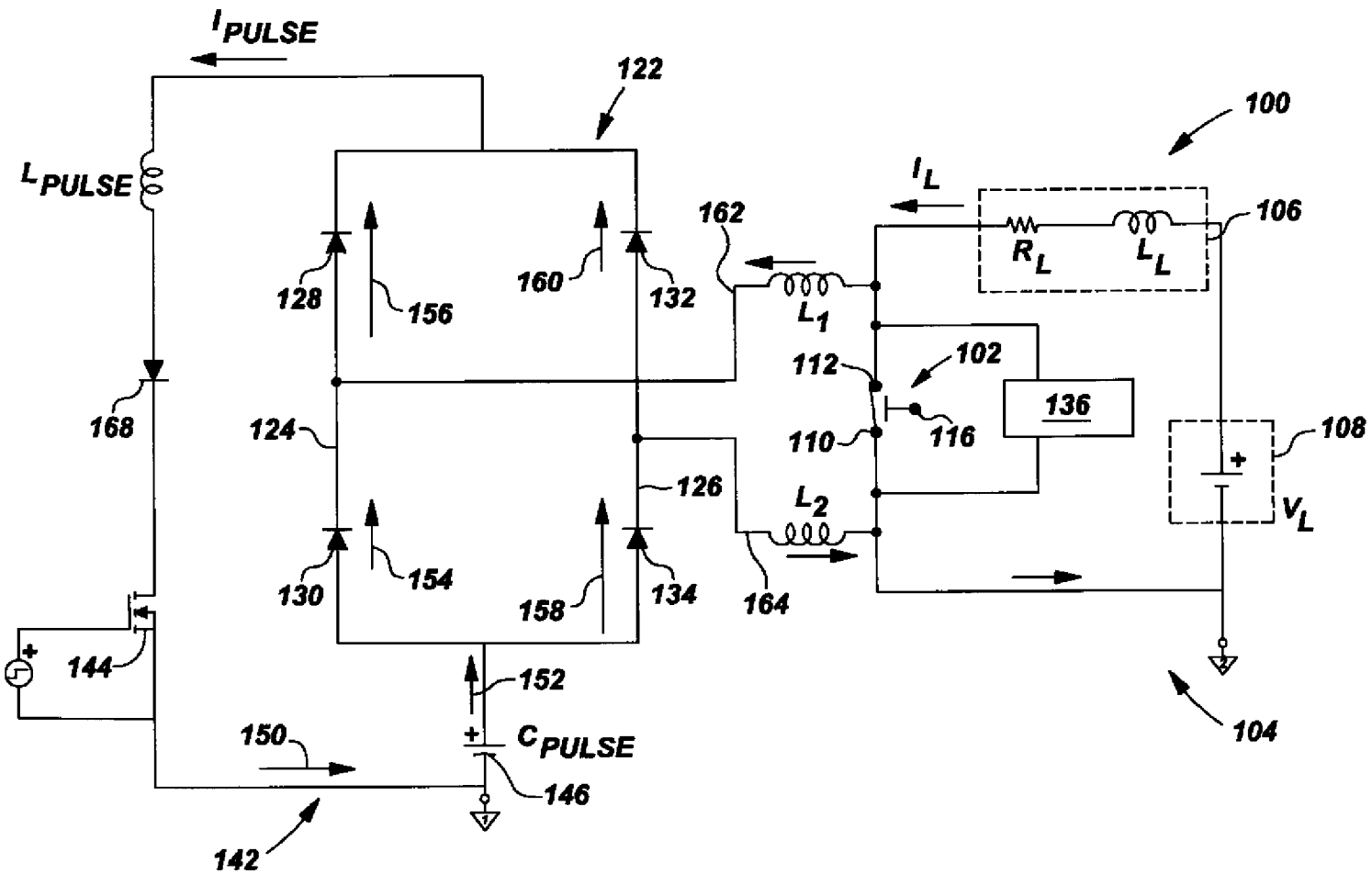
Figure 10:
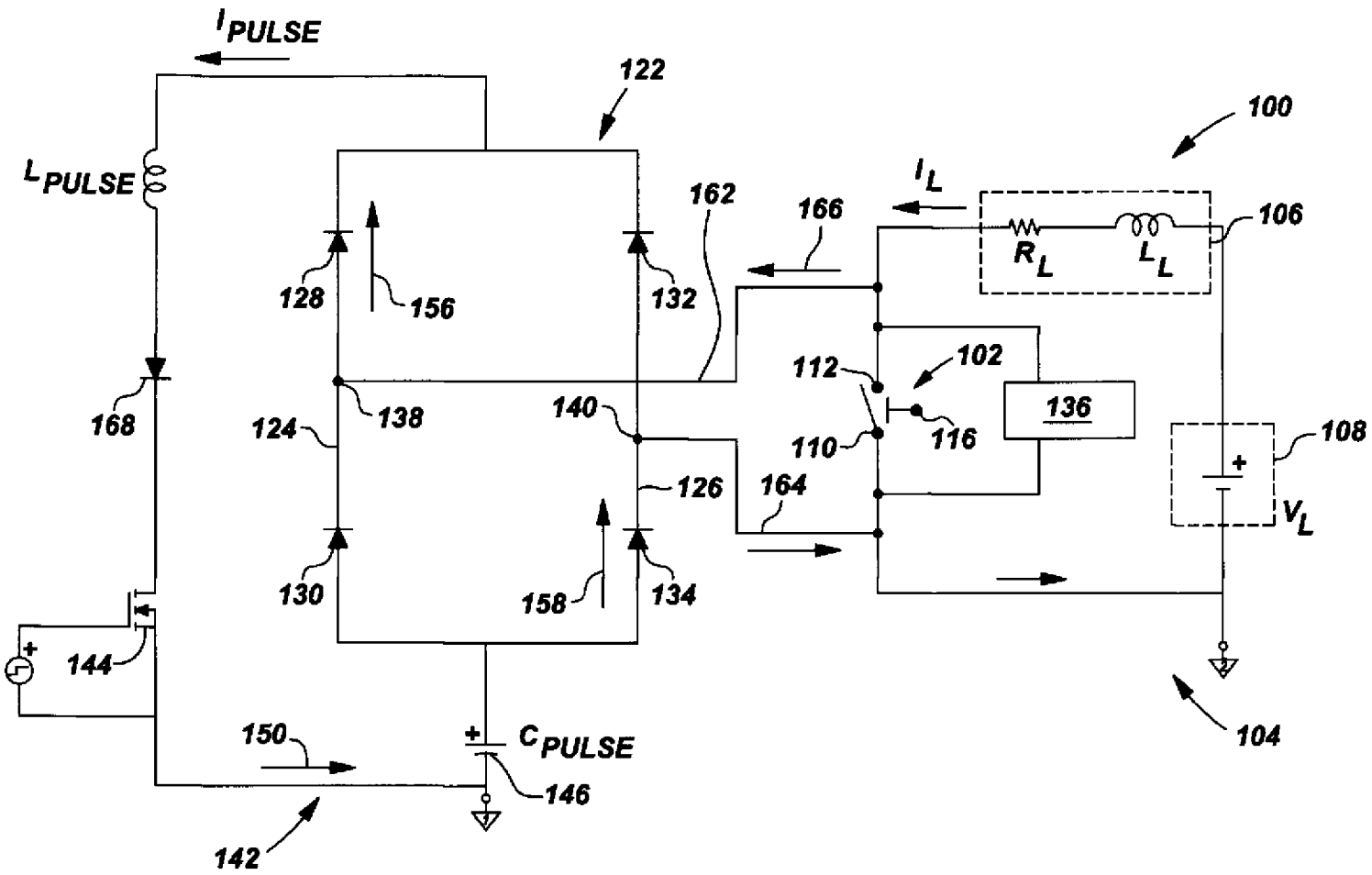
Figure 12:
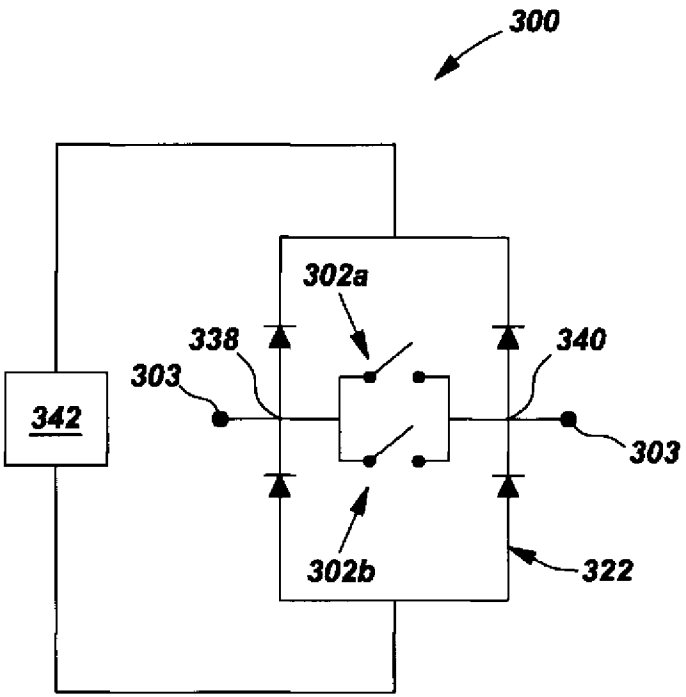
Figure 11:
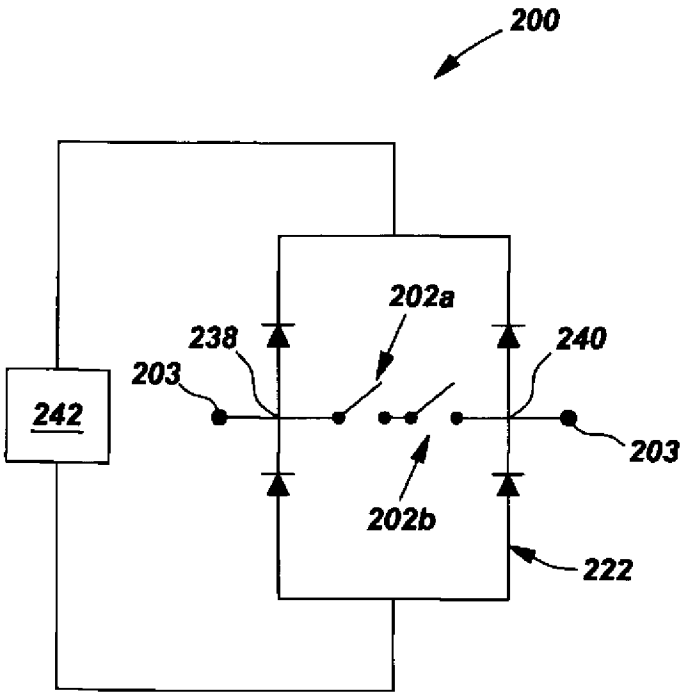
Figure 13:
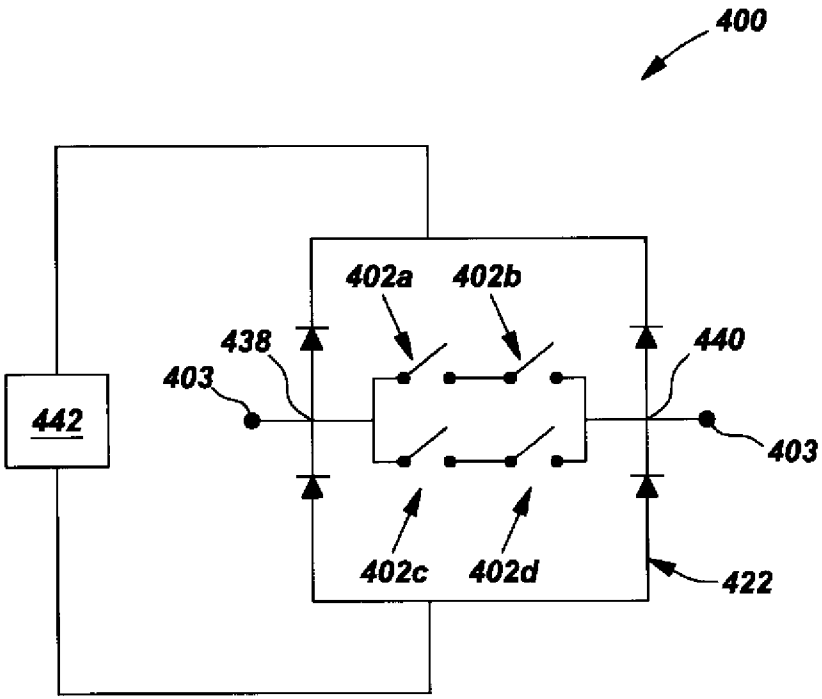
Figure 14:
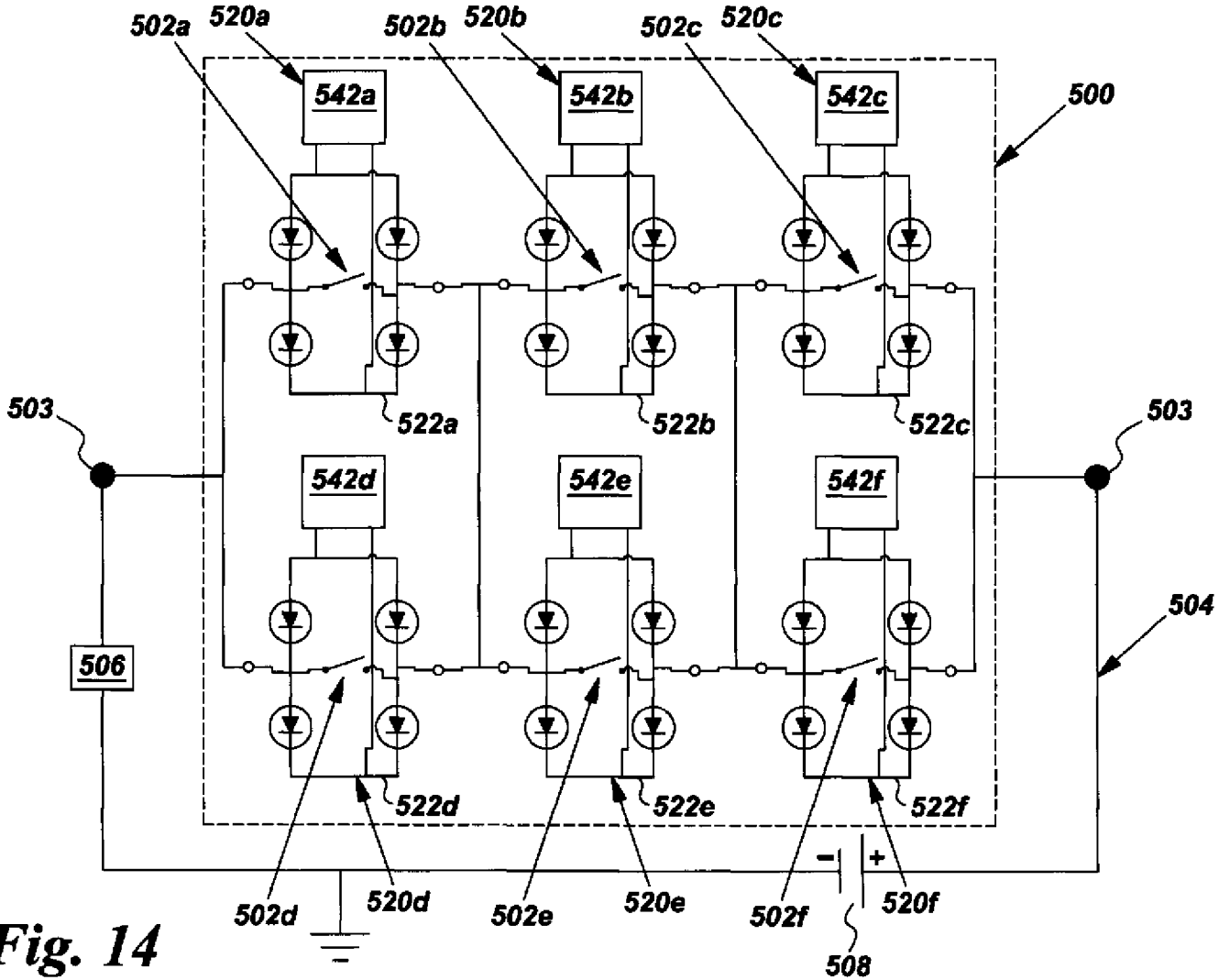
Figure 15:
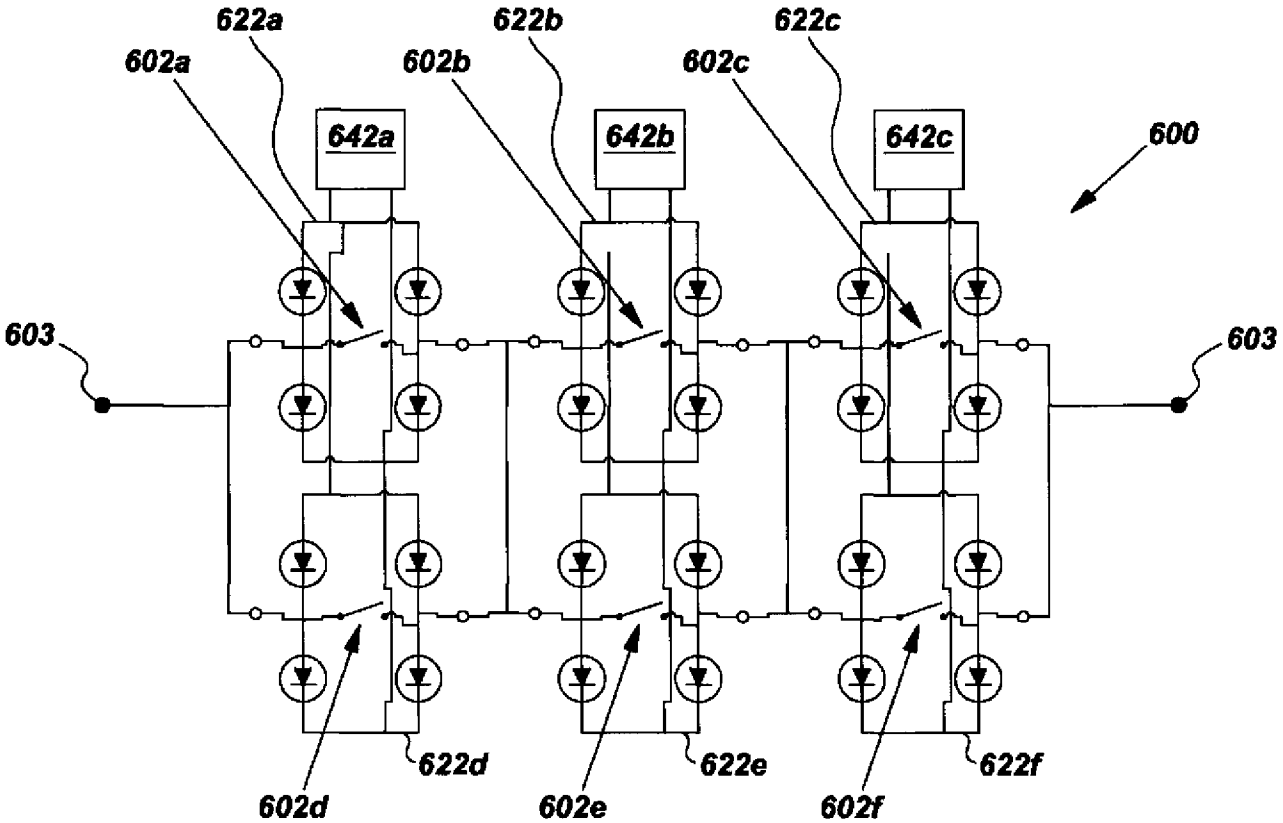
Figure 16:
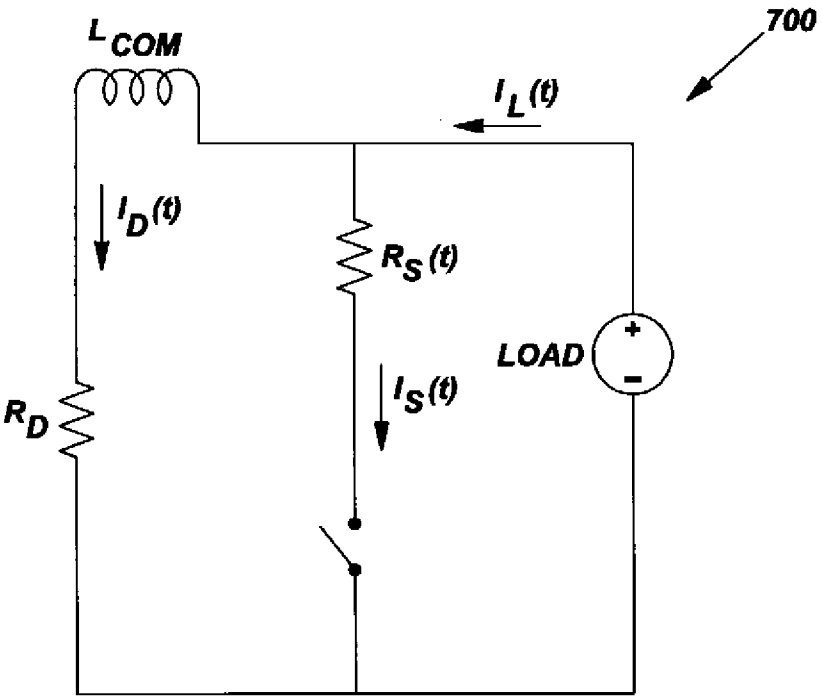

Referring to FIGS. 1 and 16, $I_L(t)$ represents the load (or fault) current. During a load current pulse, $I_L(t)$ is determined entirely by the external circuit. $I_B(t)$ and $I_S(t)$ are portions of the load current that flow through the diode bridge 122 and through the switch 102. When the transfer process starts, all of the current may be flowing through the switch 102. The resistance $R_S(t)$ of the switch 102 may vary as a function of time, being initially at a minimum value $R_{SMIN}$ when the switch is in a fully-closed configuration and rising to infinity as the switch opens. $L_{COM}$ is the inductance of the commutation circuit 142 through which the current accomplishing the commutation flows, which current can be computed, for example, by analyzing the packaging and connections of the commutation circuit 142, with shorted diodes 128, 130, 132, 134, and computing the effective inductance as seen from the points of connection 162, 164. $R_D$ is the equivalent resistance of the diode bridge 122 as seen from the MEMS switch 102 (in many cases, the equivalent resistance $R_D$ of the diode bridge is a nonlinear function of the currents flowing through the commutation circuit 142 and the load circuit 104, but this resistance can be approximated well enough with a linear resistor).

The snubber circuit 136 is ignored for the purposes of the equivalent circuit 700. While the switch 102 is opening, the voltage across the switch is limited to the melt voltage of the switch (on the order of 0.5 to 1.0 V). The snubber circuit 136 must therefore induce a change of voltage no greater than the melt voltage. This factor limits the allowable capacitance associated with the snubber circuit to around 20 nanofarads, and with a switch opening time around 8 microseconds, the current flowing through the snubber circuit 136 during a switching event of the switch 102 is expected to be less than 0.2% of the total load current. Therefore, the snubber circuit 136 has practically no effect on the transient voltage across the switch 102 until after the switch is open, and the snubber circuit 136 can be ignored during the commutation process.

The transient behavior of the circuit in FIG. 16 is governed by a first order, time dependent differential equation:

$$L_D \cdot \frac{dI_D(t)}{dt} = R_S(t) \cdot (I_L(t) - I_D(t)) - R_D \cdot I_D(t) \qquad (1)$$
$$I_D(0) = 0$$

Equation (1) can be rewritten as:

$$L_D \cdot \frac{dI_D(t)}{dt} + (R_D + R_S(t)) \cdot I_D(t) = R_S(t) \cdot I_L(t) \qquad (2)$$
$$I_D(0) = 0$$

Equation (2) has a closed form solution, even with arbitrary functions of time for both the array switch resistance and the load current, given by:

$$I_D(t) = \frac{1}{L_{COM}} \cdot \int_0^t \left( e^{\frac{-1}{L_{COM}} \cdot \int_\tau^t (R_D + R_S(\lambda)) \cdot d\lambda} \right) \cdot R_S(\tau) \cdot I_L(\tau) \cdot d\tau \qquad (3)$$

Assuming that the diode resistance $R_D$ is so small as to be negligible ($R_D$=0), the load current is approximately constant during the switching event ($I_L(t)=I_L$), and the opening of the switch 102 is spread evenly over a characteristic time $T_C$, such that the switch resistance $R_S(t)$ is given by:

$$R_S(t) = \frac{R_{SMIN}}{1 - t/T_C}, \quad 0 \le t \le T_C \tag{4}$$

Direct substitution of (4) into (3) and simplification produces a simple expression for the diode current $I_D(t)$:

$$I_D(t)=I_L\cdot(1-(1-t/T_C)^{R_{SMIN}\cdot T_C/L_{COM}}) \tag{5}$$

Subtracting the diode current $I_D(t)$ in Equation (5) from the load current yields the switch current $I_S(t)$:

$$I_S(t)=I_L\cdot(1-t/T_C)^{R_{SMIN}\cdot T_C/L_{COM}} \tag{6}$$

Equation (6) can be multiplied by the expression for the switch resistance $R_S(t)$ given by Equation (4) to determine the voltage $V_S(t)$ across the switch 102:

$$V_S(t)=I_L\cdot R_{SMIN}\cdot(1-t/T_C)^{R_{SMIN}\cdot T_C/L_{COM}-1} \tag{7}$$

From Equation (7), it can be seen that the behavior of the voltage $V_S(t)$ across the switch 102 depends on the sign of the exponent. If the exponent is positive ($L_{COM}<R_{SMIN}\cdot T_C$), the switch voltage $V_S(t)$ decays over; if the exponent is zero ($L_{COM}=R_{SMIN}\cdot T_C$), the voltage $V_S(t)$ is constant; and if the exponent is negative ($L_{COM}>R_{SMIN}\cdot T_C$), the voltage $V_S(t)$ rises over time (to a singularity). Physically, the value of $T_C=L_{COM}/R_{SMIN}$ marks the boundary between two different situations. For larger values of $T_C$, current is diverted to the diode bridge 122 faster than it is rejected by the opening switch 102, so that the current through the switch decreases over the course of a switching event. However, for smaller values of $T_C$, the current cannot divert to the diode bridge 122 fast enough, and current through the switch 102 increases over time.

By disposing the switch 102 and the balanced diode bridge 122 such that the total inductance associated with said commutation circuit $L_{COM}\leqq R_{SMIN}\cdot T_C$, the voltage $V_S(t)$ across the switch 102 can, in some embodiments, be caused to remain constant or decay over the time associated with a switching event. In this way, damaging voltage surges when the switch 102 is opened may be mitigated in some embodiments.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed:

1. An apparatus comprising:

an electromechanical switch structure configured to move between an open configuration and a fully-closed configuration over a characteristic time, said electromechanical switch structure having a minimum characteristic resistance when in the fully-closed configuration; and a commutation circuit connected in parallel with said electromechanical switch structure and including a balanced diode bridge configured to suppress arc formation between contacts of said electromechanical switch structure; and a pulse circuit including a pulse capacitor configured to form a pulse signal for causing flow of a pulse current through said balanced diode bridge, the pulse signal being generated in connection with a switching event of said electromechanical switch structure, wherein said electromechanical switch structure and said balanced diode bridge are disposed such that a total inductance associated with said commutation circuit is less than or equal to a product of the characteristic time and the minimum characteristic resistance.

2. The apparatus of claim 1, further comprising a second electromechanical switch structure configured to move between an open configuration and a fully-closed configuration over a second characteristic time, said second electromechanical switch structure having a second minimum characteristic resistance when in the fully closed configuration, wherein said electromechanical switch structure is a first electromechanical switch structure that is configured to move between an open configuration and a fully-closed configuration over a first characteristic time and to have a first minimum characteristic resistance when in the fully closed configuration, and wherein said first and second electromechanical switch structures are configured to connect in parallel to a load circuit, and wherein said commutation circuit is connected in parallel with each of said first and second electromechanical switch structures, and wherein said balanced diode bridge is a first balanced diode bridge configured to suppress arc formation between contacts of said first electromechanical switch structure, and wherein said commutation circuit further includes a second balanced diode bridge configured to suppress arc formation between contacts of said second electromechanical switch structure, and wherein said pulse circuit includes a pulse capacitor configured to form a pulse signal for causing flow of a pulse current through each of said first and second balanced diode bridges, the pulse signal being generated in connection with a switching event of said first and second electromechanical switch structures, and wherein said first and second electromechanical switch structures and said first and second balanced diode bridges are disposed such that a total inductance associated with said pulse circuit and said first balanced diode bridge is less than or equal to a product of the first characteristic time and the first minimum characteristic resistance and a total inductance associated with said pulse circuit and said second balanced diode bridge is less than or equal to a product of the second characteristic time and the second minimum characteristic resistance.

3. The apparatus of claim 1, wherein said electromechanical switch structure includes a microelectromechanical switch.

4. The apparatus of claim 1, wherein said electromechanical switch structure includes one or more contacts and one or more moveable elements, each of said one or more moveable elements being in maximum contact with at least one of said one or more contacts when said electromechanical switch structure is disposed in the fully-closed configuration and each of said one or more moveable elements being separated from said one or more contacts when said electromechanical switch structure is disposed in the open configuration.

5. The apparatus of claim 1, wherein said electromechanical switch structure includes a moveable element, a contact, and an electrode configured to selectively receive a charge so as to establish a potential difference with said moveable element and thereby urge said moveable element over the characteristic time between a maximum contacting position, in which said moveable element makes maximum contact with said contact, and a non-contacting position, in which said moveable element is separated from said contact.

6. The apparatus of claim 1, wherein said electromechanical switch structure is configured to move between an open configuration and a fully-closed configuration over a characteristic time that is less than or equal to about 15 microseconds.

7. The apparatus of claim 1, wherein said electromechanical switch structure includes an array of electromechanical switches having a minimum characteristic effective array resistance when in the fully-closed configuration.

8. The apparatus of claim 7, wherein said array of electromechanical switches includes at least two electromechanical switches connected in parallel.

9. The apparatus of claim 7, wherein said array of electromechanical switches includes at least two electromechanical switches connected in series.

10. The apparatus of claim 7, wherein said array of electromechanical switches includes at least two electromechanical switches connected in parallel and at least two electromechanical switches connected in series.

11. An apparatus comprising:

a first electromechanical switch structure configured to move between a fully-open configuration and a fully-closed configuration over a first characteristic time, said first electromechanical switch structure having a first minimum characteristic resistance when in the fully closed configuration;

a second electromechanical switch structure configured to move between a fully-open configuration and a fully-closed configuration over a second characteristic time, said second electromechanical switch structure having a second minimum characteristic resistance when in the fully closed configuration, said second electromechanical switch structure being configured to connect to a load circuit in parallel or in series with said first electromechanical structure; and a first commutation circuit connected in parallel with said first electromechanical switch structure and including a first balanced diode bridge configured to suppress arc formation between contacts of said first electromechanical switch structure; and a first pulse circuit including a pulse capacitor configured to form a pulse signal for causing flow of a pulse current through said first balanced diode bridge, the pulse signal being generated in connection with a switching event of said first electromechanical switch structure; and a second commutation circuit connected in parallel with said second electromechanical switch structure and including a second balanced diode bridge configured to suppress arc formation between contacts of said second electromechanical switch structure; and a second pulse circuit including a pulse capacitor configured to form a pulse signal for causing flow of a pulse current through said second balanced diode bridge, the pulse signal being generated in connection with a switching event of said second electromechanical switch structure, wherein said first electromechanical switch structure and said first balanced diode bridge are disposed such that a total inductance associated with said first commutation circuit is less than or equal to a product of the first characteristic time and the first minimum characteristic resistance, and wherein said second electromechanical switch structure and said second balanced diode bridge are disposed such that a total inductance associated with said second commutation circuit is less than or equal to a product of the second characteristic time and the second minimum characteristic resistance.

12. The apparatus of claim 11, wherein said first and second electromechanical switch structures each includes a microelectromechanical switch.

13. The apparatus of claim 11, wherein said first electromechanical switch structure includes one or more contacts and one or more moveable elements, each of said one or more moveable elements being in maximum contact with at least one of said one or more contacts when said first electromechanical switch structure is disposed in the fully-closed configuration and each of said one or more moveable elements being separated from said one or more contacts when said first electromechanical switch structure is disposed in the open configuration.

14. The apparatus of claim 11, wherein said first and second electromechanical switch structures each includes a moveable element, a contact, and an electrode configured to selectively receive a charge so as to establish a potential difference with said moveable element and thereby urge said moveable element over the characteristic time between a maximum contacting position, in which said moveable element makes maximum contact with said contact, and a non-contacting position, in which said moveable element is separated from said contact.

15. The apparatus of claim 11, wherein said first and second electromechanical switch structures each is configured to move between an open configuration and a fully-closed configuration over a characteristic time that is less than or equal to about 15 microseconds.

16. The apparatus of claim 11, wherein said first and second electromechanical switch structures each includes an array of electromechanical switches having a minimum characteristic effective array resistance when in the fully-closed configuration.

17. The apparatus of claim 16, wherein said array of electromechanical switches includes at least two electromechanical switches connected in parallel.

18. The apparatus of claim 16, wherein said array of electromechanical switches includes at least two electromechanical switches connected in series.

19. The apparatus of claim 16, wherein said array of electromechanical switches includes at least two electromechanical switches connected in parallel and at least two electromechanical switches connected in series.

20. A method comprising:

providing an apparatus including an electromechanical switch structure configured to move between an open configuration and a fully-closed configuration, the electromechanical switch structure having a minimum characteristic resistance when in the fully-closed configuration, and a commutation circuit connected in parallel with the electromechanical switch structure and including a balanced diode bridge configured to suppress arc formation between contacts of said electromechanical switch structure, and a pulse circuit including a pulse capacitor configured to form a pulse signal for causing flow of a pulse current through said balanced diode bridge, the pulse signal being generated in connection with a switching event of said electromechanical switch structure;

applying an electrostatic force to move the electromechanical switch structure into the fully-closed configuration; and varying the electrostatic force so as to move the electromechanical switch structure over a characteristic time from the fully-closed configuration to the open configuration, wherein the characteristic time is greater than a total inductance associated with said commutation circuit divided by the minimum characteristic resistance.

* * * * *

UNITED STATES PATENT AND TRADEMARK OFFICE

CERTIFICATE OF CORRECTION

PATENT NO. : 8,054,589 B2
APPLICATION NO. : 12/639060
DATED : November 8, 2011
INVENTOR(S) : Arun Virupaksha Gowda It is certified that error appears in the above-identified patent and that said Letters Patent is hereby corrected as shown below:

The title page should be deleted and substitute therefor the attached title page.

Drawings:

Delete drawing sheets 1-13, and substitute therefor the drawing sheets consisting of Figs. 1-13 as shown on the attached pages.

In Column 7, Line 48, delete "h," and insert -- $I_L$, -- therefor.

Signed and Sealed this
Seventh Day of August, 2012

David J. Kappos

David J. Kappos
*Director of the United States Patent and Trademark Office*

(12) United States Patent
Gowda et al.

(10) Patent No.: US 8,054,589 B2
(45) Date of Patent: Nov. 8, 2011

(54) SWITCH STRUCTURE AND ASSOCIATED CIRCUIT

(75) Inventors: Arun Virupaksha Gowda, Rexford, NY (US); Kathleen Ann O'Brien, Niskayuna, NY (US); John Norton Park, Rexford, NY (US); William James Premerlani, Scotia, NY (US); Owen Junnis Samuel Schelenz, Schenectady, NY (US); Kanakasabapathi Subramanian, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 125 days.

(21) Appl. No.: 12/639,060

(22) Filed: Dec. 16, 2009

(65) Prior Publication Data

US 2011/0140546 A1 Jun. 16, 2011

(51) Int. Cl.
*H01H 9/42* (2006.01)
*H01H 73/18* (2006.01)

(52) U.S. Cl. ..... 361/2; 361/8; 361/11; 361/13; 338/61

(58) Field of Classification Search ..... 361/2, 8, 361/11, 13; 338/61
See application file for complete search history.

(56) References Cited

U.S. PATENT DOCUMENTS

| | | | | |
|---|---|---|---|---|
| 4,070,641 | A * | 1/1978 | Khalid | 338/61 |
| 5,616,972 | A | 4/1997 | Weiser | |
| 6,630,725 | B1 * | 10/2003 | Kuo et al. | 257/659 |
| 6,649,852 | B2 * | 11/2003 | Chason et al. | 200/181 |
| 6,815,739 | B2 * | 11/2004 | Huff et al. | 257/275 |
| 6,873,223 | B2 * | 3/2005 | Stokes et al. | 333/105 |
| 7,012,327 | B2 * | 3/2006 | Huff et al. | 257/686 |
| 7,079,363 | B2 * | 7/2006 | Chung | 361/13 |
| 7,119,943 | B2 * | 10/2006 | Nelson et al. | 359/291 |
| 7,274,278 | B2 * | 9/2007 | Weller et al. | 333/262 |
| 7,486,488 | B2 * | 2/2009 | Wakatsuki et al. | 361/11 |
| 7,542,250 | B2 | 6/2009 | Premerlani et al. | |
| 7,554,222 | B2 | 6/2009 | Kumfer et al | |
| 7,589,942 | B2 | 9/2009 | Kumfer et al | |

(Continued)

FOREIGN PATENT DOCUMENTS

| | | |
|---|---|---|
| EP | 2045823 A2 | 4/2009 |
| EP | 2056325 A2 | 5/2009 |
| FR | 2797359 A1 | 2/2001 |

OTHER PUBLICATIONS

European Search Report dated Mar. 24, 2011 and Written Opinion

*Primary Examiner* — Rexford Barnie
*Assistant Examiner* — Zeev V Kitov
(74) *Attorney, Agent, or Firm* — Richard D. Emery

(57) ABSTRACT

An apparatus, such as a switch module, is provided. The apparatus can include an electromechanical switch structure configured to move between an open configuration and a fully-closed configuration (associated with a minimum characteristic resistance) over a characteristic time. A commutation circuit can be connected in parallel with the electromechanical switch structure, and can include a balanced diode bridge configured to suppress arc formation between contacts of the electromechanical switch structure and a pulse circuit including a pulse capacitor configured to form a pulse signal (in connection with a switching event of the electromechanical switch structure) for causing flow of a pulse current through the balanced diode bridge. The electromechanical switch structure and the balanced diode bridge can be disposed such that a total inductance associated with the commutation circuit is less than or equal to a product of the characteristic time and the minimum characteristic resistance.

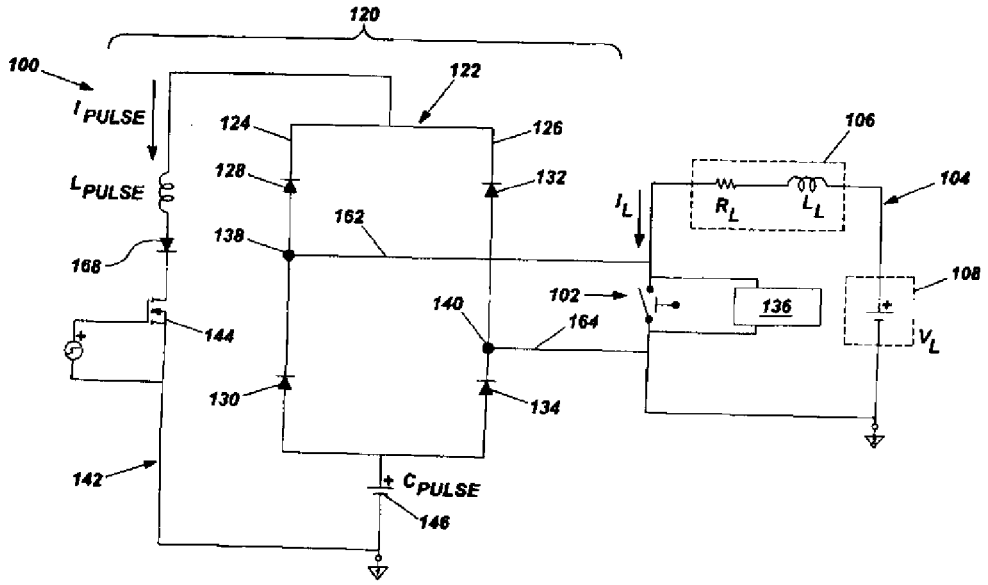

20 Claims, 16 Drawings